US011590755B2

(12) United States Patent
Shinkawa

(10) Patent No.: US 11,590,755 B2
(45) Date of Patent: Feb. 28, 2023

(54) LIQUID EJECTION DEVICE

(71) Applicant: SEIKO EPSON CORPORATION, Tokyo (JP)

(72) Inventor: Osamu Shinkawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/133,811

(22) Filed: Dec. 24, 2020

(65) Prior Publication Data

US 2021/0197558 A1 Jul. 1, 2021

(30) Foreign Application Priority Data

Dec. 26, 2019 (JP) ..... JP2019-235445

(51) Int. Cl.
*B41J 29/38* (2006.01)
*B41J 2/045* (2006.01)

(52) U.S. Cl.
CPC ..... *B41J 2/04588* (2013.01); *B41J 2/04541* (2013.01); *B41J 2/04581* (2013.01)

(58) Field of Classification Search
CPC ..... B41J 2/04541; B41J 2/0455; B41J 2/0458
See application file for complete search history.

(56) References Cited

U.S. PATENT DOCUMENTS 4,907,013 A 3/1990 Hubbard et al.
6,454,377 B1 * 9/2002 Ishizaki ..... B41J 2/04541 347/68
10,308,021 B2 6/2019 Nomura et al.
10,960,665 B2 3/2021 Nomura et al.
2002/0163963 A1 11/2002 Moote et al.
2004/0227782 A1 11/2004 Shinkawa et al.
2007/0279449 A1 12/2007 Mori et al.
2009/0189933 A1 7/2009 Nakano
2010/0100799 A1 4/2010 Kurachi et al.
2010/0149239 A1 * 6/2010 Sheahan ..... B41J 2/04591 347/11
2015/0077463 A1 3/2015 Hosokawa
2015/0170008 A1 6/2015 Hashizume
2015/0191017 A1 7/2015 Matsumoto et al.
2017/0001433 A1 1/2017 Anderson et al.
2019/0009531 A1 * 1/2019 Furukawa ..... B41J 2/04593
2019/0202203 A1 7/2019 Suzuki

FOREIGN PATENT DOCUMENTS

CN 1753788 A 3/2006
CN 104441991 A 3/2015
CN 204659202 U 9/2015
CN 205220090 U 5/2016
JP 2016-049691 A 4/2016
JP 2019-119192 A 7/2019

* cited by examiner

*Primary Examiner* — Lam S Nguyen
(74) *Attorney, Agent, or Firm* — Global IP Counselors, LLP

(57) ABSTRACT

A liquid ejection device includes a first head unit that includes a plurality of first ejection portions, a second head unit that includes a plurality of second ejection portions, a head controller that controls the first head unit and the second head unit, and a signal path via which determination information indicating whether or not a liquid ejection state of one first ejection portion among the plurality of first ejection portions is abnormal is transmitted from the first head unit to the second head unit without passing through the head controller.

8 Claims, 17 Drawing Sheets

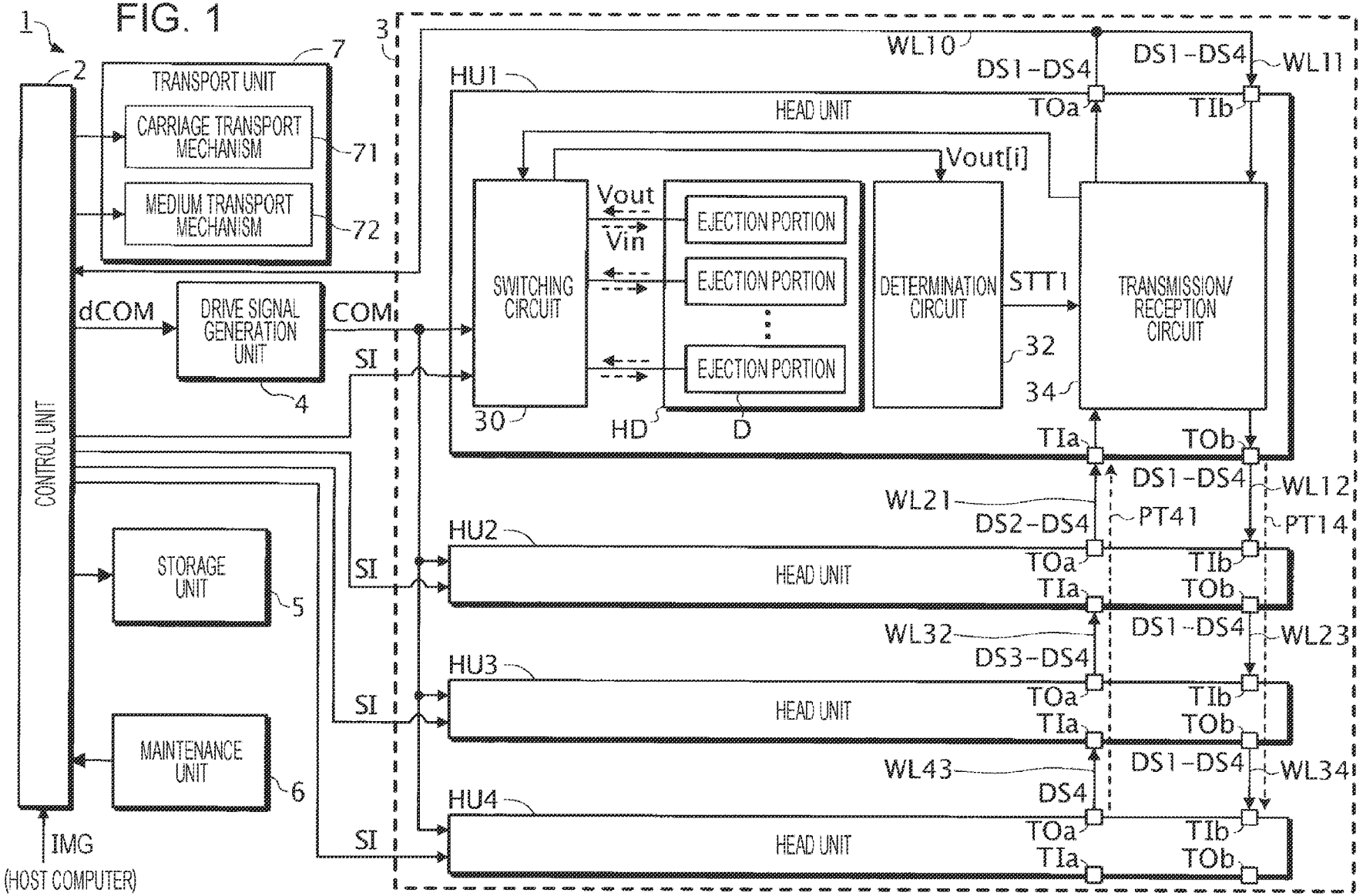
FIG. 1
TRANSPORT UNIT
CARRIAGE TRANSPORT MECHANISM
MEDIUM TRANSPORT MECHANISM
DRIVE SIGNAL GENERATION UNIT
STORAGE UNIT
MAINTENANCE UNIT
CONTROL UNIT
IMG
(HOST COMPUTER)
dCOM
COM
SI
TRANSMISSION/ RECEPTION CIRCUIT
DETERMINATION CIRCUIT
SWITCHING CIRCUIT
EJECTION PORTION
HEAD UNIT
Vout
Vin
Vout[i]
STT1
DS1-DS4
DS2-DS4
DS3-DS4
DS4
TIa
TIb
TOa
TOb
WL10
WL11
WL12
WL21
WL23
WL32
WL34
WL43
PT14
PT41
HU1
HU2
HU3
HU4
HD
D
1
2
3
4
5
6
7
30
32
34
71
72

FIG. 11

| Sdo[i] (b1,b2,b3) | DESIGNATED CONTENT FOR Sdo[i] | Qa[i] | | Qb[i] | | | Qs[i] | | |
|---|---|---|---|---|---|---|---|---|---|
| | | Tu1 | Tu2 | TSS1 | TSS2 | TSS3 | TSS1 | TSS2 | TSS3 |
| (1, 1, 0) | LARGE DOT | H | H | L | L | L | L | L | L |
| (1, 0, 0) | MEDIUM DOT | H | L | L | L | L | L | L | L |
| (0, 1, 0) | SMALL DOT | L | H | L | L | L | L | L | L |
| (0, 0, 0) | NON-RECORDING | L | L | L | L | L | L | L | L |
| (1, 1, 1) | DETERMINATION TARGET | L | L | H | L | H | L | H | L |

FIG. 15

| STT | | NOZZLE STATE | COPING |
|---|---|---|---|
| STTa | STTb | | |
| 0 | 0 | NORMAL | NORMAL PRINTING PROCESS |
| 1 | 0 | ABNORMAL | COMPLEMENTARY PRINTING PROCESS, NOZZLE MAINTENANCE PROCESS |
| 1 | 1 | FAILURE | COMPLEMENTARY PRINTING PROCESS |

FIG. 16

| STT | | | | | NOZZLE STATE | COPING |
|---|---|---|---|---|---|---|
| STTa | STTb | STTc | STTd | STTe | | |
| 0 | 0 | 0 | 0 | 0 | NORMAL | NORMAL PRINTING PROCESS |
| 1 | 0 | 1 | 0 | 0 | BUBBLE | COMPLEMENTARY PRINTING PROCESS, NOZZLE MAINTENANCE PROCESS |
| 1 | 0 | 0 | 1 | 0 | THICKENING | COMPLEMENTARY PRINTING PROCESS, NOZZLE MAINTENANCE PROCESS |
| 1 | 0 | 0 | 0 | 1 | ADHESION | COMPLEMENTARY PRINTING PROCESS, NOZZLE MAINTENANCE PROCESS |
| 1 | 1 | 0 | 0 | 0 | FAILURE | COMPLEMENTARY PRINTING PROCESS |

FIG. 17

| ARRANGEMENT INFORMATION | NOZZLE ARRANGEMENT (X ← ⊙ Z, ↓ Y) | | | | | | | | | | | | | |
|---|---|---|---|---|---|---|---|---|---|---|---|---|---|---|
| 01 (ARRANGED IN ONE ROW) | 1 | 2 | 3 | 4 | 5 | 6 | 7 | 8 | 9 | 10 | 11 | 12 | 13 | 14 |
| 02 (ARRANGED IN ONE ROW) | 14 | 13 | 12 | 11 | 10 | 9 | 8 | 7 | 6 | 5 | 4 | 3 | 2 | 1 |
| 03 (ARRANGED IN TWO ROWS) | 1 | 2 | 3 | 4 | 5 | 6 | 7 | 8 | 9 | 10 | 11 | 12 | 13 | 14 |
| | 15 | 16 | 17 | 18 | 19 | 20 | 21 | 22 | 23 | 24 | 25 | 26 | 27 | 28 |
| 04 (ARRANGED IN TWO ROWS) | 1 | 3 | 5 | 7 | 9 | 11 | 13 | 15 | 17 | 19 | 21 | 23 | 25 | 27 |
| | 2 | 4 | 6 | 8 | 10 | 12 | 14 | 16 | 18 | 20 | 22 | 24 | 26 | 28 |
| 05 (ARRANGED IN ZIGZAG) | 1 | 2 | 3 | 4 | 5 | 6 | 7 | 8 | 9 | 10 | 11 | 12 | 13 | 14 |
| | 15 | 16 | 17 | 18 | 19 | 20 | 21 | 22 | 23 | 24 | 25 | 26 | 27 | |
| 06 (ARRANGED IN ZIGZAG) | 1 | 3 | 5 | 7 | 9 | 11 | 13 | 15 | 17 | 19 | 21 | 23 | 25 | 27 |
| | 2 | 4 | 6 | 8 | 10 | 12 | 14 | 16 | 18 | 20 | 22 | 24 | 26 | |

LIQUID EJECTION DEVICE

The present application is based on, and claims priority from JP Application Serial Number 2019-235445, filed Dec. 26, 2019, the disclosure of which is hereby incorporated by reference herein in its entirety.

BACKGROUND

1. Technical Field

The present disclosure relates to a liquid ejection device.

2. Related Art

JP-A-2016-049691 discloses a liquid ejection device such as an ink jet printer that ejects a liquid such as ink from each of a plurality of ejection portions included in a head unit to form an image on a medium, and has a determination section that executes a determination process for determining an ejection state of the ink from each ejection portion. In this type of liquid ejection device, for example, whenever a determination process for one ejection portion among a plurality of ejection portions is finished, a determination portion outputs determination information indicating a determination result for the ejection portion to a control portion controlling a head unit and the like. JP-A-2019-119192 discloses a liquid ejection device having a plurality of head units.

Meanwhile, in a liquid ejection device having a plurality of head units, for example, there is a demand for high-speed cooperation between the head units based on determination information indicating a determination result for each ejection portion included in one head unit and determination information indicating a determination result of each ejection portion included in another head unit.

SUMMARY

In order to solve the above problem, according to an aspect of the present disclosure, there is provided a liquid ejection device including a first head unit that includes a plurality of first ejection portions; a second head unit that includes a plurality of second ejection portions; a head controller that controls the first head unit and the second head unit; and a signal path via which determination information indicating whether or not a liquid ejection state of one first ejection portion among the plurality of first ejection portions is abnormal is transmitted from the first head unit to the second head unit without passing through the head controller.

BRIEF DESCRIPTION OF THE DRAWINGS

FIG. 1 is a block diagram illustrating an example of a configuration of an ink jet printer according to an embodiment of the present disclosure.

FIG. 11 is an explanatory diagram for describing generation of a coupling state designation signal in a designation signal generation portion.

FIG. 15 is an explanatory diagram for describing an example of determination information according to Modification Example 3.

FIG. 16 is an explanatory diagram for describing another example of determination information according to Modification Example 3.

FIG. 17 is an explanatory diagram for describing an arrangement of nozzles according to Modification Example 4.

DESCRIPTION OF EXEMPLARY EMBODIMENTS

Figure 2:
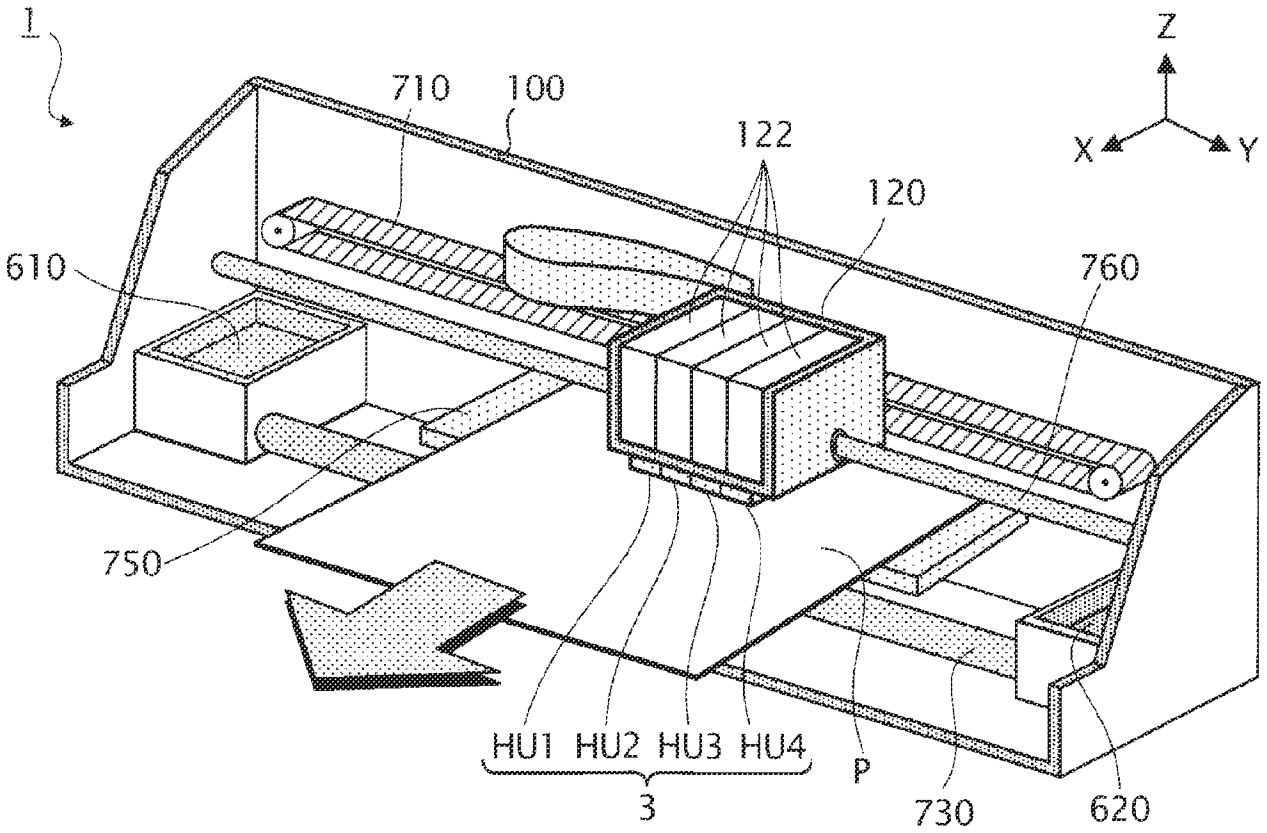
FIG. 2 is a perspective view illustrating an example of a schematic internal structure of the ink jet printer.

Hereinafter, embodiments of the present disclosure will be described with reference to the drawings. However, in each drawing, the size and scale of each constituent are appropriately different from the actual ones. The embodiment described below is a preferred specific example of the present disclosure, so that various technically preferable limitations are attached thereto, but the scope of the present disclosure is not limited to these forms unless it is particularly stated that the present disclosure is limited in the following description.

1. EMBODIMENT

First, a configuration of an ink jet printer 1 according to the present embodiment will be described with reference to FIGS. 1 and 2.

FIG. 1 is a block diagram illustrating an example of a configuration of the ink jet printer 1 according to the embodiment of the present disclosure. In the present embodiment, a liquid ejection device will be described by exemplifying the ink jet printer 1 that ejects ink to form an image on recording paper P. In the present embodiment, the ink is an example of a "liquid", and the recording paper P is an example of a "medium".

Printing data IMG indicating an image to be formed on the recording paper P by the ink jet printer 1 is supplied to the ink jet printer 1 from a host computer such as a personal computer or a digital camera. For example, the ink jet printer 1 executes a printing process of forming an image indicated by the printing data IMG supplied from the host computer on the recording paper P. The printing data IMG is an example of "image information". The ink jet printer 1 may have any one of a copy function, a scanner function, a facsimile transmission function, and a facsimile reception function in addition to the printing function. In other words, the ink jet printer 1 may correspond to a so-called "multifunction peripheral".

In the example illustrated in FIG. 1, the ink jet printer 1 includes a control unit 2, a head module 3 including head units HU1, HU2, HU3, and HU4, a drive signal generation unit 4, a storage unit 5, a maintenance unit 6, and a transport unit 7. Hereinafter, the head units HU1, HU2, HU3, and HU4 will be referred to as a head unit HU when the head units are not required to be differentiated from each other in some cases. The control unit 2 is an example of a "head controller".

In the present embodiment, as illustrated in FIG. 1, a case where the head module 3 includes four head units HU is assumed as an example. Hereinafter, among the four head units HU, the head unit HU1 will be described, but the description also applies to the other head units HU. For example, as illustrated in FIG. 1, the head unit HU1 includes a switching circuit 30, a recording head HD including a plurality of ejection portions D that eject ink, a determination circuit 32, and a transmission/reception circuit 34. Although functional blocks of the other head units HU are not illustrated, each of the head units HU2, HU3, and HU4 also includes the switching circuit 30, the recording head HD, the determination circuit 32, and the transmission/reception circuit 34, in the same manner as the head unit HU1. Details of the switching circuit 30, the recording head HD, the determination circuit 32, and the transmission/reception circuit 34 will be described later.

Here, any of the head units HU1, HU2, HU3, and HU4 is an example of a "first head unit". When the head unit HU1 corresponds to a "first head unit", the plurality of ejection portions D included in the head unit HU1 correspond to "a plurality of first ejection portions", and the head unit HU4 corresponds to a "second head unit", and the plurality of ejection portions D included in the head unit HU4 correspond to "a plurality of second ejection portions". When the head unit HU2 corresponds to a "first head unit", the plurality of ejection portions D included in the head unit HU2 correspond to a "plurality of first ejection portions", and the head unit HU3 corresponds to a "second head unit", and the plurality of ejection portions D included in the head unit HU3 correspond to a "plurality of second ejection portions". When the head unit HU3 corresponds to a "first head unit", the plurality of ejection portions D included in the head unit HU3 correspond to a "plurality of first ejection portions", and the head unit HU2 corresponds to a "second head unit", and the plurality of ejection portions D included in the head unit HU2 correspond to a "plurality of second ejection portions". When the head unit HU4 corresponds to a "first head unit", the plurality of ejection portions D included in the head unit HU4 correspond to a "plurality of first ejection portions", and the head unit HU1 corresponds to a "second head unit", and the plurality of ejection portions D included in the head unit HU1 correspond to a "plurality of second ejection portions".

The control unit 2 is, for example, a computer such as a central processing unit (CPU) that controls each constituent of the ink jet printer 1. The control unit 2 may have one or more processors. For example, the control unit 2 executes a control program stored in the storage unit 5 to generate signals such as a printing signal SI and a waveform designation signal dCOM for controlling an operation of each constituent of the ink jet printer 1. All or some of the elements realized by the control unit 2 executing the control program may be realized by hardware such as an electronic circuit including a field programmable gate array (FPGA) or an application specific integrated circuit (ASIC). Alternatively, all or some of the functions of the control unit 2 may be realized by software and hardware in cooperation.

Here, the waveform designation signal dCOM is a digital signal for defining a waveform of an analog drive signal COM for driving the ejection portion D. For example, the waveform designation signal dCOM is supplied from the control unit 2 to the drive signal generation unit 4. The printing signal SI is a digital signal for designating the type of operation of the ejection portion D. Specifically, the printing signal SI is a signal for designating the type of operation of the ejection portion D by designating whether or not the drive signal COM is supplied to the ejection portion D. The printing signal SI defines an ejection amount of ink ejected from each ejection portion D by designating whether or not the drive signal COM is supplied to the ejection portion D. In other words, the control unit 2 controls the head units HU1 to HU4 by using the printing signal SI, the waveform designation signal dCOM, and the like.

The drive signal generation unit 4 includes a DA conversion circuit and generates the drive signal COM having a waveform defined by the waveform designation signal dCOM. In the present embodiment, it is assumed that the drive signal COM includes a drive signal COMa and a drive signal COMb.

The storage unit 5 is configured to include a volatile memory such as a random access memory (RAM), and a nonvolatile memory such as a read only memory (ROM), an electrically erasable programmable read-only memory (EEPROM), or a programmable ROM (PROM). For example, the storage unit 5 stores various kinds of information such as the printing data IMG supplied from the host computer and the control program for the ink jet printer 1.

When an ejection state of ink in the ejection portion D becomes abnormal, the maintenance unit 6 performs a maintenance process for recovering the ejection state of the ink in the ejection portion D to a normal state. The ejection state includes a state in which ink is not ejected from the ejection portion D. The ejection state of the ink in the ejection portion D is determined by the determination circuit 32 which will be described later. In the following description, the ejection of ink ejected from the ejection portion D becomes abnormal, that is, a state in which the ejection portion D cannot eject the ink accurately may be referred to as abnormal ejection. For example, the abnormal ejection includes a state in which ink cannot be ejected from the ejection portion D, a state in which the ejection portion D ejects ink in an amount that is different from an ejection amount of ink defined by the drive signal COM, and a state in which the ejection portion D ejects ink at a speed that is different from an ink ejection speed defined by the drive signal COM.

The transport unit 7 has a carriage transport mechanism 71 reciprocating a carriage 120 illustrated in FIG. 2 described later, and a medium transport mechanism 72 transporting the recording paper P, and changes a relative position of the recording paper P with respect to the head module 3. An operation and the like of the transport unit 7 will be described with reference to FIG. 2.

As described above, each head unit HU included in the head module 3 has the switching circuit 30, the recording head HD, the determination circuit 32, and the transmission/reception circuit 34. The recording head HD includes 2×M ejection portions D. Here, the value M is "M≥1", M being a natural number. In the following description, "2×M" may be simply referred to as "2M". In the following description, among the 2M ejection portions D provided in the recording head HD, the i-th ejection portion D may be referred to as an ejection portion D[i]. Here, the variable i is "1≤i≤2M", M being a natural number. In the following description, when a constituent element of or a signal for the ink jet printer 1 corresponds to the ejection portion D[i] among the 2M ejection portions D, the reference numeral for representing the constituent element or the signal may be added with the subscript [i].

The switching circuit 30 switches whether or not to supply the drive signal COM output from the drive signal generation unit 4 to the ejection portion D[i] based on the printing signal SI. In the following description, among the drive signals COM, the drive signal COM supplied to the ejection portion D[i] may be referred to as a supply drive signal Vin[i]. The switching circuit 30 switches whether or not to supply a detection signal Vout[i] indicating a potential of an upper electrode Zu[i] of a piezoelectric element PZ[i] included in the ejection portion D[i] to the determination circuit 32 based on the printing signal SI. The piezoelectric element PZ[i] and the upper electrode Zu[i] will be described later with reference to FIG. 8.

The determination circuit 32 generates determination information STT1[*i*] indicating a determination result of the ink ejection state in the ejection portion D[i] based on the detection signal Vout[i]. Specifically, the determination circuit 32 generates a remaining vibration signal based on the detection signal Vout[i]. The determination circuit 32 compares feature amounts such as a cycle and an amplitude of the remaining vibration signal based on the detection signal Vout[i] with reference feature amounts when an ejection state is normal, so as to determine an ink ejection state in the ejection portion D[i], and generates the determination information STT1[*i*] indicating the determination result. Hereinafter, the ejection portion D that is a target of an ejection state determined by the determination circuit 32 may be referred to as the determination target ejection portion D.

Here, the remaining vibration signal based on the detection signal Vout[i] indicates a waveform of remaining vibration that is vibration remaining in the ejection portion D[i] after the ejection portion D[i] is driven by the supply drive signal Vin[i]. The number at the end of the reference sign of the determination information STT1 corresponds to the number at the end of the reference sign of the head unit HU1. Therefore, for example, the determination information STT indicating a determination result of an ink ejection state in the ejection portion D included in the head unit HU4 may also be referred to as determination information STT4. Any of the 2M pieces of determination information STT for the head unit HU corresponding to the "first head unit" is an example of "determination information".

In the present embodiment, a method of using the remaining vibration signal is assumed as a method of determining an ink ejection state in the ejection portion D. However, the method of determining the ink ejection state in the ejection portion D is not limited to the method using the remaining vibration signal. For example, as a method of determining the ejection state of the ink in the ejection portion D, a method of detecting a temperature decrease occurring in the ejection portion D when the ink is ejected normally may be adopted. In this type of determination method, when a change point at which a temperature decrease rate changes after a certain time from the time at which a detected temperature reaches the maximum temperature appears, the ink ejection state is determined as being normal, and, when the change point does not appear, the ink ejection state is determined as being abnormal. For example, as the method of determining the ink ejection state in the ejection portion D, there may be the use of a method of ejecting charged ink from the ejection portion D toward a detection plate used to detect the ink ejection state and detecting a current change when the ink collides with the detection plate. For example, as the method of determining the ink ejection state in the ejection portion D, there may be the use of a method of ejecting charged ink from the ejection portion D toward an ink reception portion, and detecting the presence or absence of an induced current generated in a conductor portion when the ink passes a side part of the conductor portion disposed between the ejection portion D and the ink reception portion.

The transmission/reception circuit 34 combines, for example, a data set DS1 including the determination information STT1 output from the determination circuit 32 with data sets DS2, DS3, and DS4 supplied to a terminal TIa of the head unit HU1, and outputs the combined result to a terminal TOa of the head unit HU1. The data set DS2 is a data set DS including the determination information STT2 for the head unit HU2, the data set DS3 is a data set DS including the determination information STT3 for the head unit HU3, and the data set DS4 is a data set DS including the determination information STT4 for the head unit HU4.

The transmission/reception circuit 34 outputs, for example, the data sets DS1, DS2, DS3, and DS4 supplied to the terminal TIb of the head unit HU1 to the terminal TOb of the head unit HU1.

In the example illustrated in FIG. 1, a wiring WL10 electrically couples the terminal TOa of the head unit HU1 to the control unit 2. A wiring WL11 electrically couples the terminal TOa of the head unit HU1 to the terminal TIb of the head unit HU1. A wiring WL12 electrically couples the terminal TOb of the head unit HU1 to the terminal TIb of the head unit HU2. A wiring WL21 electrically couples the terminal TOa of the head unit HU2 to the terminal TIa of the head unit HU1.

A wiring WL32 electrically couples the terminal TOa of the head unit HU3 to the terminal TIa of the head unit HU2, and a wiring WL23 electrically couples the terminal TOb of the head unit HU2 to the terminal TIb of the head unit HU3. A wiring WL43 electrically couples the terminal TOa of the head unit HU4 to the terminal TIa of the head unit HU3, and a wiring WL34 electrically couples the terminal TOb of the head unit HU3 to the terminal TIb of the head unit HU4. In the example illustrated in FIG. 1, the terminal TIa and the terminal TOb of the head unit HU4 are not coupled to the other head units HU. Next, a flow of each data set DS when the head units HU1, HU2, HU3, and HU4 are coupled as illustrated in FIG. 1 will be described.

For example, in the head unit HU4, the transmission/reception circuit 34 transmits the data set DS4 including the determination information STT4 output from the determination circuit 32 to the terminal TIa of the head unit HU3. In the head unit HU3, the transmission/reception circuit 34 transmits the data set DS3 including the determination information STT3 output from the determination circuit 32 and the data set DS4 supplied to the terminal TIa, to the terminal TIa of the head unit HU2 in an order of the data sets DS3 and DS4.

In the head unit HU2, the transmission/reception circuit 34 transmits the data set DS2 including the determination information STT2 output from the determination circuit 32 and the data sets DS3 and DS4 supplied to the terminal TIa, to the terminal TIa of the head unit HU1 in an order of the data sets DS2, DS3, and DS4. Thus, for example, the data set DS4 for the head unit HU4 is transmitted to the head unit HU1 via the head units HU3 and HU2 without passing through the control unit 2. Hereinafter, a transmission path of the data set DS4 from the terminal TOa of the head unit HU4 to the terminal TIa of the head unit HU1 may be referred to as a data path PT41. As described above, the data path PT41 is a transmission path used to transmit the data set DS4 from the head unit HU4 to the head unit HU1 without passing through the control unit 2. The data path PT41 is an example of a "signal path". The wiring WL32 used to transmit the data set DS3 from the head unit HU3 to the head unit HU2 without passing through the control unit 2 is another example of the "signal path".

In the head unit HU1, the transmission/reception circuit 34 transmits the data set DS1 including the determination information STT1 output from the determination circuit 32 and the data sets DS2, DS3, and DS4 supplied to the terminal TIa, to the control unit 2 and the terminal TIb in an order of the data sets DS1, DS2, DS3, and DS4.

In the head unit HU1, the transmission/reception circuit 34 transmits the data sets DS1, DS2, DS3, and DS4 supplied to the terminal TIb, to the terminal TIb of the head unit HU2 in the order of the data sets being supplied to the terminal TIb. Similarly, in the head unit HU2, the transmission/reception circuit 34 transmits the data sets DS1, DS2, DS3, and DS4 supplied to the terminal TIb, to the terminal TIb of the head unit HU3 in the order of the data sets being supplied to the terminal TIb. In the head unit HU3, the transmission/reception circuit 34 transmits the data sets DS1, DS2, DS3, and DS4 supplied to the terminal TIb, to the terminal TIb of the head unit HU4 in the order of the data sets being supplied to the terminal TIb.

Consequently, the data set DS for each head unit HU is supplied to the other head units HU and the control unit 2. In other words, the determination information STT for each head unit HU is supplied to the other head units HU and the control unit 2. For example, the data set DS1 for the head unit HU1 is transmitted to the head unit HU4 via the head units HU2 and HU3 without passing through the control unit 2. Hereinafter, a transmission path of the data set DS1 from the terminal TOb of the head unit HU1 to the terminal TIb of the head unit HU4 may be referred to as a data path PT14. As described above, the data path PT14 is a transmission path for transmitting the data set DS1 from the head unit HU1 to the head unit HU4 without passing through the control unit 2. The data path PT14 is another example of the "signal path". The wiring WL23 used to transmit the data set DS2 from the head unit HU2 to the head unit HU3 without passing through the control unit 2 is still another example of the "signal path".

FIG. 2 is a perspective view illustrating an example of a schematic internal structure of the ink jet printer 1. As illustrated in FIG. 2, in the present embodiment, a case where the ink jet printer 1 is a serial printer is assumed as an example. Specifically, when a printing process is executed, the ink jet printer 1 ejects ink from the ejection portions D while transporting the recording paper P in a sub-scanning direction and reciprocating the head module 3 in a main scanning direction intersecting the sub-scanning direction, and thus forms dots corresponding to the printing data IMG on the recording paper P.

Hereinafter, for convenience of description, the description will be made by using an X axis, a Y axis, and a Z axis which are orthogonal to each other illustrated in FIG. 2 as appropriate. The direction indicated by the arrow of the X axis is referred to as a +X direction, and the direction opposite to the +X direction is referred to as a −X direction. Similarly, the direction indicated by the arrow of the Y axis is referred to as a +Y direction, and the direction opposite to the +Y direction is referred to as a −Y direction. The direction indicated by the arrow of the Z axis is referred to as a +Z direction, and the direction opposite to the +Z direction is referred to as −Z direction. In the present embodiment, the +X direction is set to the sub-scanning direction, and the +Y direction and the −Y direction are set to the main scanning directions.

As illustrated in FIG. 2, the ink jet printer 1 includes a casing 100 and a carriage 120 that can be reciprocated in the casing 100 in the +Y direction and the −Y direction and that has the head module 3 mounted thereon. As described with reference to FIG. 1, the ink jet printer 1 includes the maintenance unit 6 and the transport unit 7.

When the printing process is performed, the transport unit 7 reciprocates the carriage 120 in the +Y direction and the −Y direction, and transports the recording paper P in the +X direction, and thus changes a relative position of the recording paper P with respect to the head module 3. Consequently, the transport unit 7 enables the ink to land onto the entire recording paper P. For example, the transport unit 7 includes a carriage guide shaft 760 that reciprocatively supports the carriage 120 in the +Y direction and the −Y direction, and a timing belt 710 that is fixed to the carriage 120 and is driven by the carriage transport mechanism 71. Consequently, the transport unit 7 can reciprocate the head module 3 together with the carriage 120 in the +Y direction and the −Y direction along the carriage guide shaft 760. The transport unit 7 has a platen 750 that is provided in the −Z direction with respect to the carriage 120, and a transport roller 730 that is rotated in response to driving of the medium transport mechanism 72 to transport the recording paper P on the platen 750 in the +X direction.

The maintenance unit 6 includes a cap 610 that covers each head unit HU such that nozzles N of the ejection portions D are sealed, and a discharged ink reception portion 620 that receives discharged ink when the ink in the ejection portion D is discharged. The maintenance unit 6 has a wiper that wipes off a foreign substance such as paper powder adhering to the vicinity of the nozzle N of the ejection portion D, and a tube pump that sucks ink, bubbles, and the like in the ejection portion D, although not particularly illustrated. The nozzle N will be described later in FIG. 3. In the present embodiment, an aspect in which the cap 610 is attached to the casing 100 is exemplified, but the present disclosure is not limited to such an aspect, and the cap 610 may be attached to the carriage 120.

In the present embodiment, a case is assumed in which the carriage 120 stores four ink cartridges 122 that respectively correspond to ink with four colors such as cyan, magenta, yellow, and black. FIG. 2 illustrates only an example, and the ink cartridge 122 may be provided outside the carriage 120. Each ejection portion D is supplied with ink from any one of the four ink cartridges 122. Each of the ejection portions D may be filled with the ink supplied from the ink cartridge 122 and may eject the ink filling the inside thereof from the nozzle N. The ink cartridge 122 may be provided outside the carriage 120.

Here, a description will be made of an outline of an operation of the control unit 2 when the printing process is executed. When the printing process is executed, first, the control unit 2 stores the printing data IMG supplied from the host computer into the storage unit 5. Next, the control unit 2 generates a signal such as the printing signal SI for controlling the head unit HU, and a signal such as the waveform designation signal dCOM for controlling the drive signal generation unit 4, and a signal for controlling the transport unit 7 based on various pieces of data such as the printing data IMG stored in the storage unit 5. The control unit 2 controls the transport unit 7 to change a relative position of the recording paper P with respect to the head module 3, and also controls the drive signal generation unit 4 and the switching circuit 30 such that the ejection portion D is driven, based on various signals such as the printing signal SI or various pieces of data stored in the storage unit 5. Therefore, the control unit 2 controls each constituent of the ink jet printer 1 to execute a printing process of forming an image corresponding to the printing data IMG on the recording paper P by adjusting the presence or absence of ink ejection from the ejection portion D, an ink ejection amount, an ink ejection timing, and the like.

A configuration of the ink jet printer 1 is not limited to the examples illustrated in FIGS. 1 and 2. For example, the number of head units HU may be two or three. Alternatively, the number of head units HU may be five or more. The ink jet printer 1 may be a line printer in which the plurality of nozzles N are provided to extend larger than the width of the recording paper P in the recording head HD.

Figure 3:
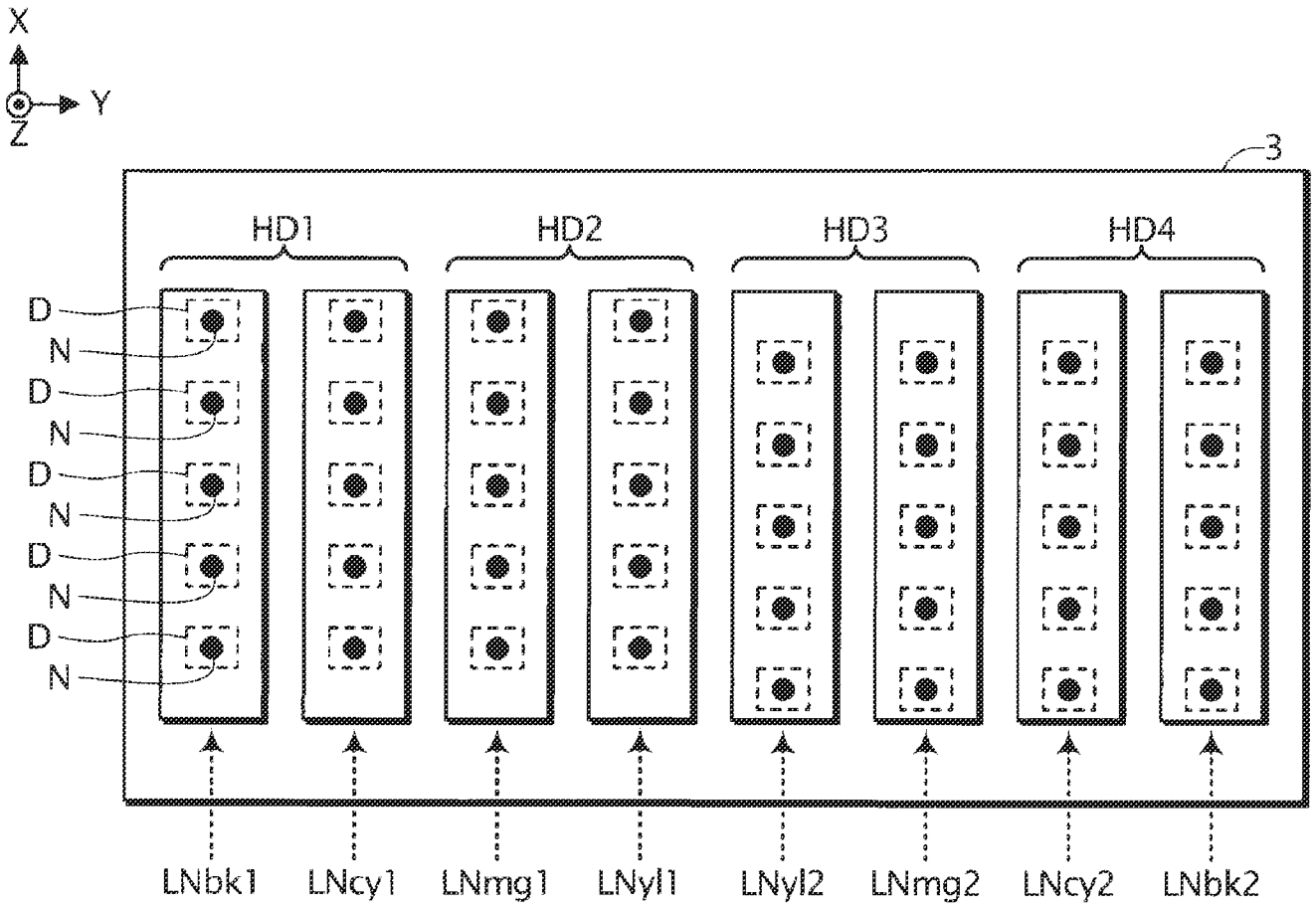
FIG. 3 is a plan view illustrating an example of the arrangement of nozzles in the head module.

FIG. 3 is a plan view illustrating an example of an arrangement of the nozzles N in the head module 3. FIG. 3 is an explanatory diagram for describing an example of an arrangement of four recording heads HD and a total of 8M nozzles N provided in the four recording heads HD in a plan view of the ink jet printer 1 from the +Z direction. In FIG. 3, in order to differentiate the four recording heads HD from each other, the same number as a number added to the end of the reference sign of the head unit HU including the recording head HD is added to the end of the reference sign of the recording head HD. For example, the recording head HD1 indicates the recording head HD included in the head unit HU1.

Each of the four recording heads HD is provided with a plurality of nozzle strings LN. Here, the nozzle string LN is a plurality of nozzles N provided to extend in a row in a predetermined direction. In the present embodiment, a case is assumed in which each nozzle string LN is configured by arranging M nozzles N to extend in a row along the X axis. Hereinafter, the eight nozzle strings LN provided in the head module 3 are also referred to as nozzle strings LNbk1, LNcy1, LNmg1, LNyl1, LNbk2, LNcy2, LNmg2, and LNyl2, respectively. Hereinafter, the nozzle N of the ejection portion D belonging to one nozzle string LN among the plurality of nozzle strings LN may be simply referred to as the ejection portion D belonging to one nozzle string LN. In other words, the ejection portion D having the nozzles N belonging to one nozzle string LN among the plurality of nozzle strings LN may be referred to as the ejection portion D belonging to one nozzle string LN.

Here, the nozzle string LNbk1 of the recording head HD1 and the nozzle string LNbk2 of the recording head HD4 are the nozzle strings LN in which the nozzles N of the ejection portions D ejecting black ink are arranged and are the nozzle strings LN that are paired with each other. The nozzle string LNcy1 of the recording head HD1 and the nozzle string LNcy2 of the recording head HD4 are the nozzle strings LN in which the nozzles N of the ejection portions D ejecting cyan ink are arranged and are the nozzle strings LN that are paired with each other. The nozzle string LNmg1 of the recording head HD2 and the nozzle string LNmg2 of the recording head HD3 are the nozzle strings LN in which the nozzles N of the ejection portions D ejecting magenta ink are arranged and are the nozzle strings LN that are paired with each other. The nozzle string LNyl1 of the recording head HD2 and the nozzle string LNyl2 of the recording head HD3 are the nozzle strings LN in which the nozzles N of the ejection portions D ejecting yellow ink are arranged and are the nozzle strings LN that are paired with each other.

In the present embodiment, as will be described with reference to FIG. 4, in printing of each color, a resolution twice as high as the resolution corresponding to one nozzle string LN is achieved by using two nozzle strings LN that are paired with each other.

The arrangement of the nozzles N in each recording head HD is not limited to the example illustrated in FIG. 3. For example, the number of nozzle strings LN provided in each recording head HD may be one, or may be three or more.

Figure 4:
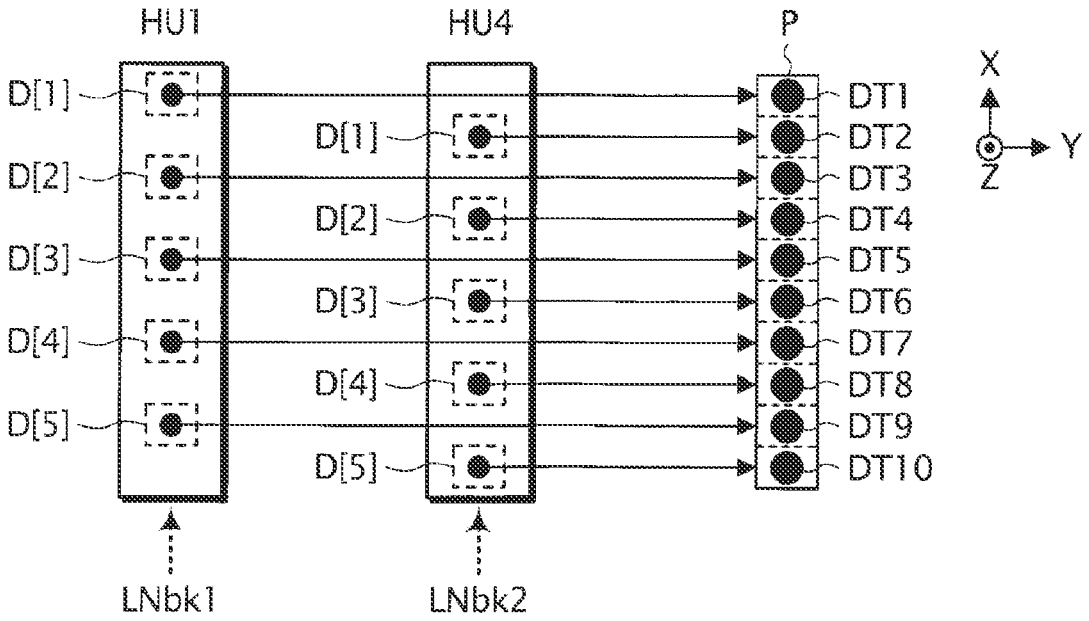
FIG. 4 is an explanatory diagram for describing a normal printing process.

FIG. 4 is an explanatory diagram for describing the normal printing process. FIG. 4 illustrates an example of an image printed on the recording paper P when ejection states of the five ejection portions D[1] to D[5] belonging to the nozzle string LNbk1 and ejection states of the five ejection portions D[1] to D[5] belonging to the nozzle string LNbk2 are normal. In FIG. 4, a case is assumed in which an ink ejection amount designated by the printing signal SI corresponds to a medium dot. For example, when the ejection states of a total of ten ejection portions D belonging to the nozzle strings LNbk1 and LNbk2 are all normal, ink with an ejection amount corresponding to the medium dot is ejected from the ten ejection portions D through the normal printing process. Consequently, ten medium dots DT1 to DT10 are formed on the recording paper P.

In the example illustrated in FIG. 4, the medium dots DT2, DT4, DT6, DT8, and DT10 corresponding to the five ejection portions D[1] to D[5] included in the head unit HU4 are formed on the same row as the row of the medium dots DT1, DT3, DT5, DT7, and DT9 corresponding to the five ejection portions D[1] to D[5] included in the head unit HU1. For example, the medium dots DT2, DT4, DT6, DT8, and DT10 are formed to fill gaps between the medium dots DT1, DT3, DT5, DT7, and DT9. Consequently, in the present embodiment, a resolution twice as high as that in a case of forming the medium dots DT1, DT3, DT5, DT7, and DT9 on the recording paper P by using only the nozzle string LNbk1 is realized.

Figure 5:
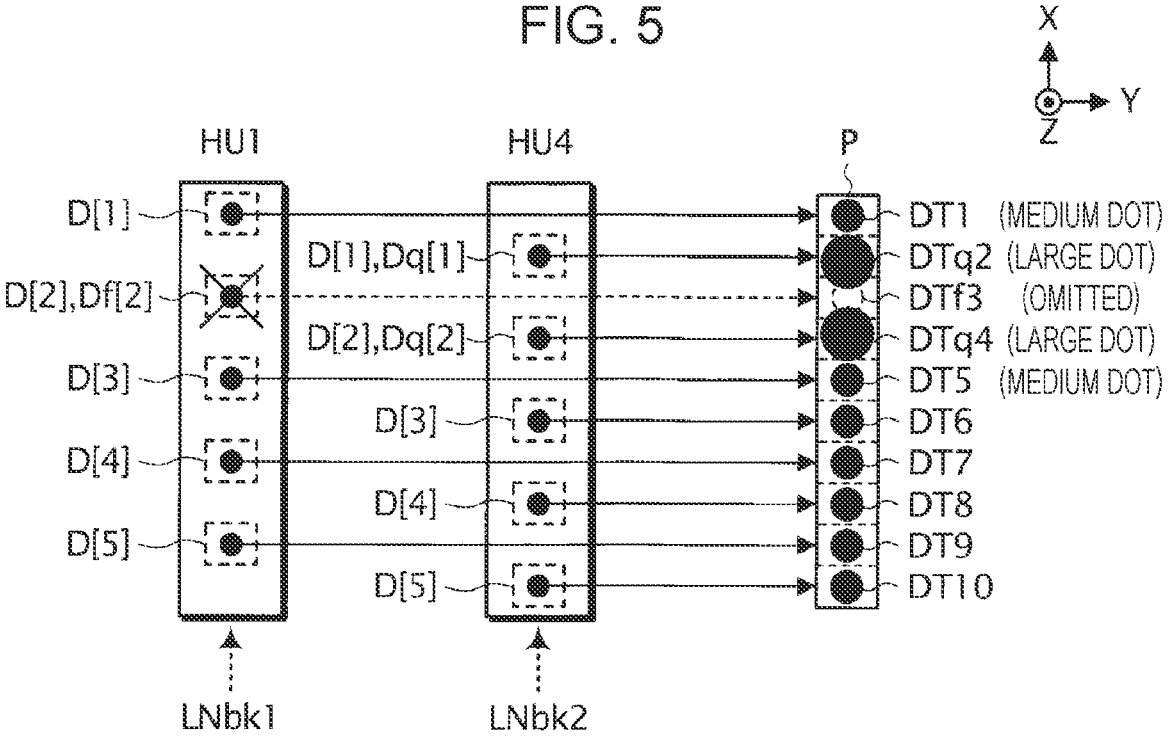
FIG. 5 is an explanatory diagram for describing a complementary printing process.

FIG. 5 is an explanatory diagram for describing the complementary printing process. In FIG. 5, a case is assumed in which, among the five ejection portions D[1] to D[5] of the head unit HU1 and the five ejection portions D[1] to D[5] of the head unit HU4, an ink ejection state in the ejection portion D[2] of the head unit HU1 is determined as being abnormal by the determination circuit 32. In this case, the ink jet printer 1 executes the complementary printing process instead of the normal printing process. Hereinafter, since the abnormal ejection occurs, the ejection portion D required to be complemented by another ejection portion D in a printing process may be referred to as an abnormal ejection portion Df, and the ejection portion that complements the abnormal ejection portion Df in the complementary printing process may be referred to as a complementing ejection portion Dq.

For example, in the complementary printing process illustrated in FIG. 5, the ejection portion D[2] belonging to the nozzle string LNbk1 is the abnormal ejection portion Df. In this case, complementing ejection portions Dq that complement the abnormal ejection portion Df[2] employ the ejection portion D[1] and the ejection portion D[2] that belong to the nozzle string LNbk2 paired with the nozzle string LNbk1 to which the abnormal ejection portion Df[2] belongs and that correspond to dots DTq2 and DTq4 adjacent to a dot DTf3 corresponding to abnormal ejection portion Df[2] in the normal printing process. In other words, in the complementary printing process exemplified in FIG. 5, the ejection portions D corresponding to the dots DT adjacent to the dot DT corresponding to the abnormal ejection portion Df in the sub-scanning direction are employed as the complementing ejection portions Dq.

In the complementary printing process, compared with the normal printing process illustrated in FIG. 4, an amount of ink ejected from the complementing ejection portions Dq[1] and Dq[2] belonging to the nozzle string LNbk2 is increased, and the supply of the drive signal COM to the abnormal ejection portion Df[2] belonging to the nozzle string LNbk1 is stopped such that driving of the abnormal ejection portion Df[2] is stopped. Consequently, in the complementary printing process, for example, large dots DTq2 and DTq4 are formed instead of the medium dots DT2 and DT4 formed in the normal printing process. Thus, in the complementary printing process, even when the dot DT3 fails to be formed and thus dot omission occurs, it is possible to form the dot DT in an aspect similar to the plurality of dots DT originally to be formed illustrated in FIG. 4 and thus to reduce the degree of deterioration in image quality due to abnormal ejection.

In the present embodiment, complementary control for increasing an amount of ink ejected from the complementing ejection portion Dq in the complementary printing process may be executed by the control unit 2 or each head unit HU. For example, the control unit 2 may generate the printing signal SI based on the printing data IMG and change the printing signal SI based on the determination information STT. In other words, the control unit 2 may generate the printing signal SI based on the printing data IMG and the determination information STT. For example, the control unit 2 may stop the transmission of the printing signal SI to the head unit HU based on the determination information STT. In other words, the control unit 2 controls the plurality of ejection portions D based on the determination information STT included in the data set DS transmitted from the head unit HU. The complementary control executed in each head unit HU will be described later with reference to FIG. 12 and the like.

In the complementary printing process illustrated in FIG. 5, a case has been described in which the abnormal ejection portion Df belongs to the nozzle string LNbk1 and the complementing ejection portion Dq belongs to the nozzle string LNbk2. However, the case is only an example, and the abnormal ejection portion Df and the complementing ejection portion Dq may belong to nozzle strings LN other than the nozzle strings LNbk1 and LNbk2.

In the complementary printing process illustrated in FIG. 5, two ejection portions D that belong to the nozzle string LN ejecting the same color ink as the abnormal ejection portion Df and correspond to two dots DT adjacent to the dot DT corresponding to the abnormal ejection portion Df are used as the complementing ejection portions Dq, but the present disclosure is not limited to such an aspect. For example, the number of the complementing ejection portion Dq may be one, and the complementing ejection portion Dq may be the ejection portion D belonging to the nozzle string LN that ejects ink with a color different from a color of ink ejected from the abnormal ejection portion Df.

In the present embodiment, as described above, the nozzle string LN included in one of the two head units HU and the nozzle string LN included in the other of the two head units HU are paired with each other. Therefore, in the present embodiment, the determination information STT for each nozzle string LN is transmitted between the head units HU in order to execute the complementary control in each head unit HU.

Figure 6:
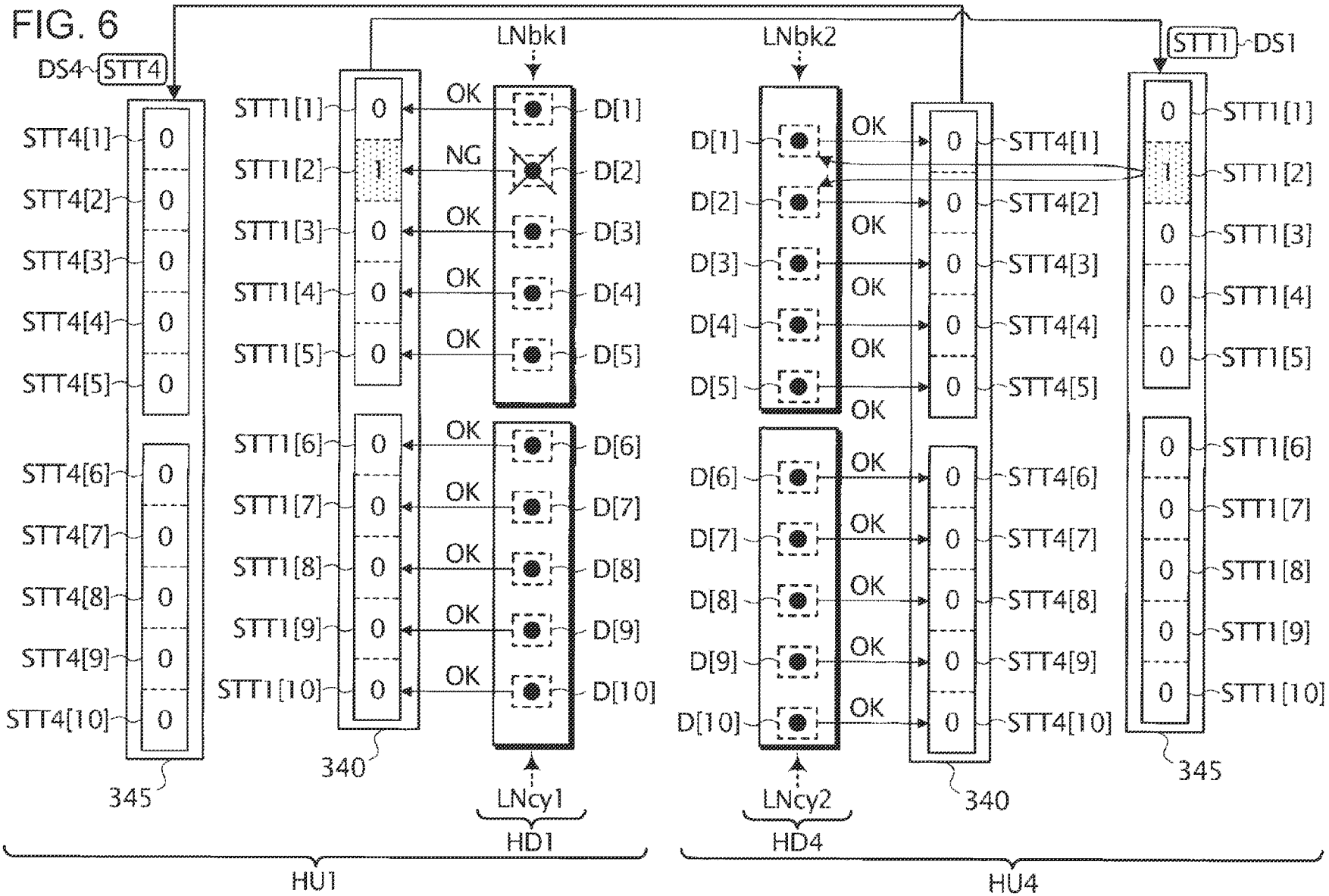
FIG. 6 is an explanatory diagram for describing transmission of determination information.

FIG. 6 is an explanatory diagram for describing transmission of the determination information STT. In FIG. 6, a description will be made of transmission of the determination information STT by exemplifying a case where the pieces of determination information STT1 and STT4 are transmitted between the head units HU1 and HU4 that are paired with each other. In FIG. 6, in an example, a case is assumed in which the recording head HD is provided with ten ejection portions D, that is, "2M=10". In FIG. 6, a case is assumed in which abnormal ejection is determined as occurring in the ejection portion D[2] of the recording head HD1. In the example illustrated in FIG. 6, the determination information STT for the ejection portion D in which abnormal ejection is determined as occurring is set to "1", and the determination information STT for the normal ejection portion D is set to "0".

The ejection portions D[1] to D[5] of the recording head HD1 belong to the nozzle string LNbk1, and the ejection portions D[6] to D[10] of the recording head HD1 belong to the nozzle string LNcy1. The ejection portions D[1] to D[5] of the recording head HD4 belong to the nozzle string LNbk2 paired with the nozzle string LNbk1, and the ejection portions D[6] to D[10] of the recording head HD4 belongs to the nozzle string LNcy2 paired with the nozzle string LNcy1.

Pieces of determination information STT1[1] to STT1[10] respectively indicating determination results of the ink ejection states in the ejection portions D[1] to D[10] of the recording head HD1 are stored in a first storage portion 340 of the head unit HU1. The data set DS1 including the determination information STT1[1] to STT1[10] is transmitted from the head unit HU1 to the head unit HU4.

The head unit HU4 stores the determination information STT1[1] to STT1[10] included in the data set DS1 received from the head unit HU1 into a second storage portion 345 of the head unit HU4. Since the determination information STT1[2] indicates "1", the head unit HU4 specifies that the ejection portion D[2] of the recording head HD1 is in an abnormal ejection state. Therefore, as described in FIG. 5, the head unit HU4 uses, as the complementing ejection portions Dq that complement the ejection portion D[2] of the recording head HD1, the ejection portion D[1] and the ejection portion D[2] of the recording head HD4.

Pieces of determination information STT4[1] to STT4[10] respectively indicating determination results of ink ejection states in the ejection portions D[1] to D[10] of the recording head HD4 are stored in the first storage portion 340 of the head unit HU4. The data set DS4 including the determination information STT4[1] to STT4[10] is transmitted from the head unit HU4 to the head unit HU1. The head unit HU1 stores the determination information STT4[1] to STT4[10] included in the data set DS4 received from the head unit HU4 into the second storage portion 345 of the head unit HU1.

In FIG. 6, the head units HU2 and HU3 are not illustrated for clarity, but, as described with reference to FIG. 1, in the present embodiment, the data set DS1 is transmitted from the head unit HU1 to the head unit HU4 via the head units HU2 and HU3. The data set DS4 is transmitted from the head unit HU4 to the head unit HU1 via the head units HU3 and HU2.

Figure 7:
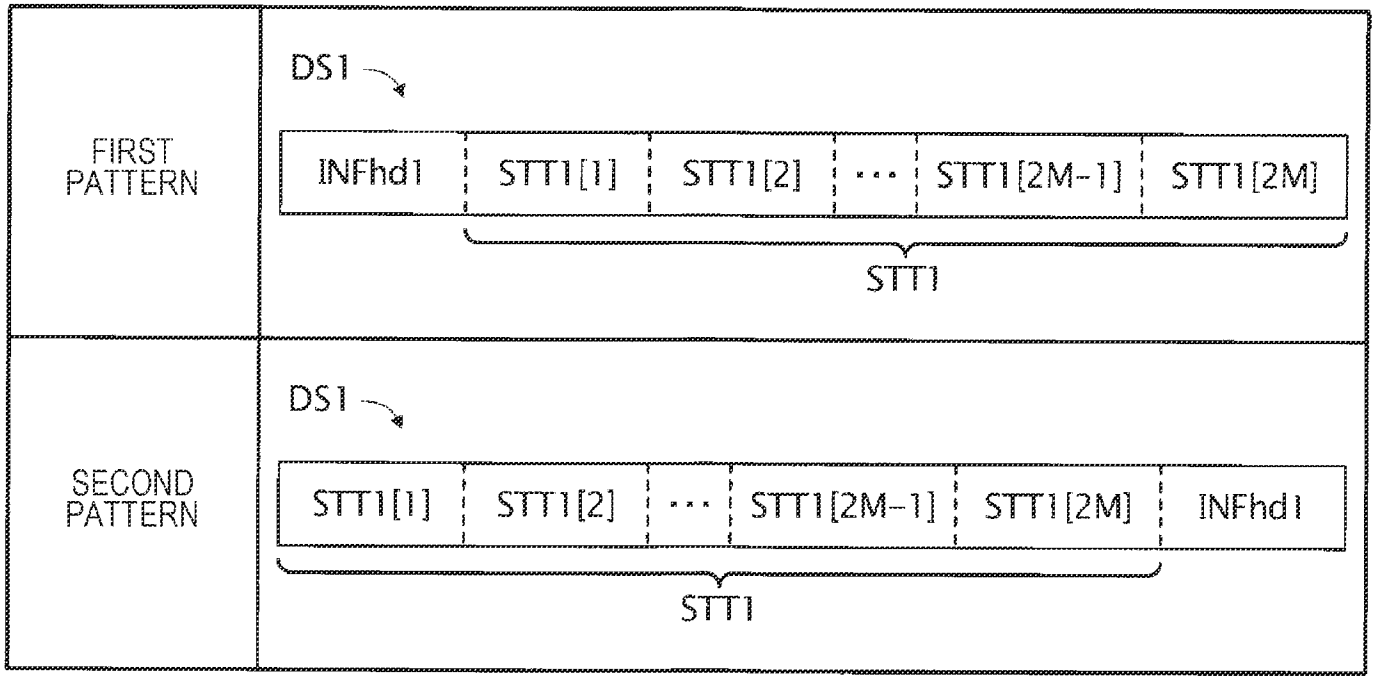
FIG. 7 is a diagram illustrating an example of a data set including the determination information.

FIG. 7 is a diagram illustrating an example of the data set DS including the determination information STT. Although the data set DS1 will be described with reference to FIG. 7, the description also applies to the other data sets DS. In the example illustrated in FIG. 7, the data set DS1 includes recording head information INFhd1 in addition to the determination information STT1. The recording head information INFhd1 may be, for example, information for causing the head unit HU4 paired with the head unit HU1 to specify the determination information STT1 included in the data set DS1. For example, the recording head information INFhd1 may include number information indicating the number of ejection portions D included in the recording head HD1. The recording head information INFhd1 may include arrangement information indicating an arrangement of the ejection portions D included in the recording head HD1. The arrangement information may include information indicating the arrangement order of the ejection portions D. The recording head information INFhd1 may include color information indicating a color of ink ejected from the nozzle string LN included in the recording head HD1.

In a first pattern illustrated in FIG. 7, the recording head information INFhd1 is disposed to be transmitted before the determination information STT1. For example, the recording head information INFhd1 is disposed at the head of the data set DS1. In a second pattern, the determination information STT1 is disposed to be transmitted before the recording head information INFhd1. For example, the recording head information INFhd1 is disposed at the end of the data set DS1.

A data configuration of the data set DS is not limited to the example illustrated in FIG. 7. For example, when information corresponding to the recording head information INFhd1 is stored in advance in each head unit HU, the recording head information INFhd1 may be omitted from the data set DS1. For example, when the recording head information INFhd1 is disposed at the end of the data set DS1, head mark information indicating the head of the data set DS1 may be disposed at the head of the data set DS1. Hereinafter, the recording head information INFhd included in each of the data sets DS2 to DS4 may be referred to by being given the same number as the number added to the end of the reference sign of the data set DS including the recording head information INFhd. For example, the recording head information INFhd included in the data set DS4 may be referred to as recording head information INFhd4.

Figure 8:
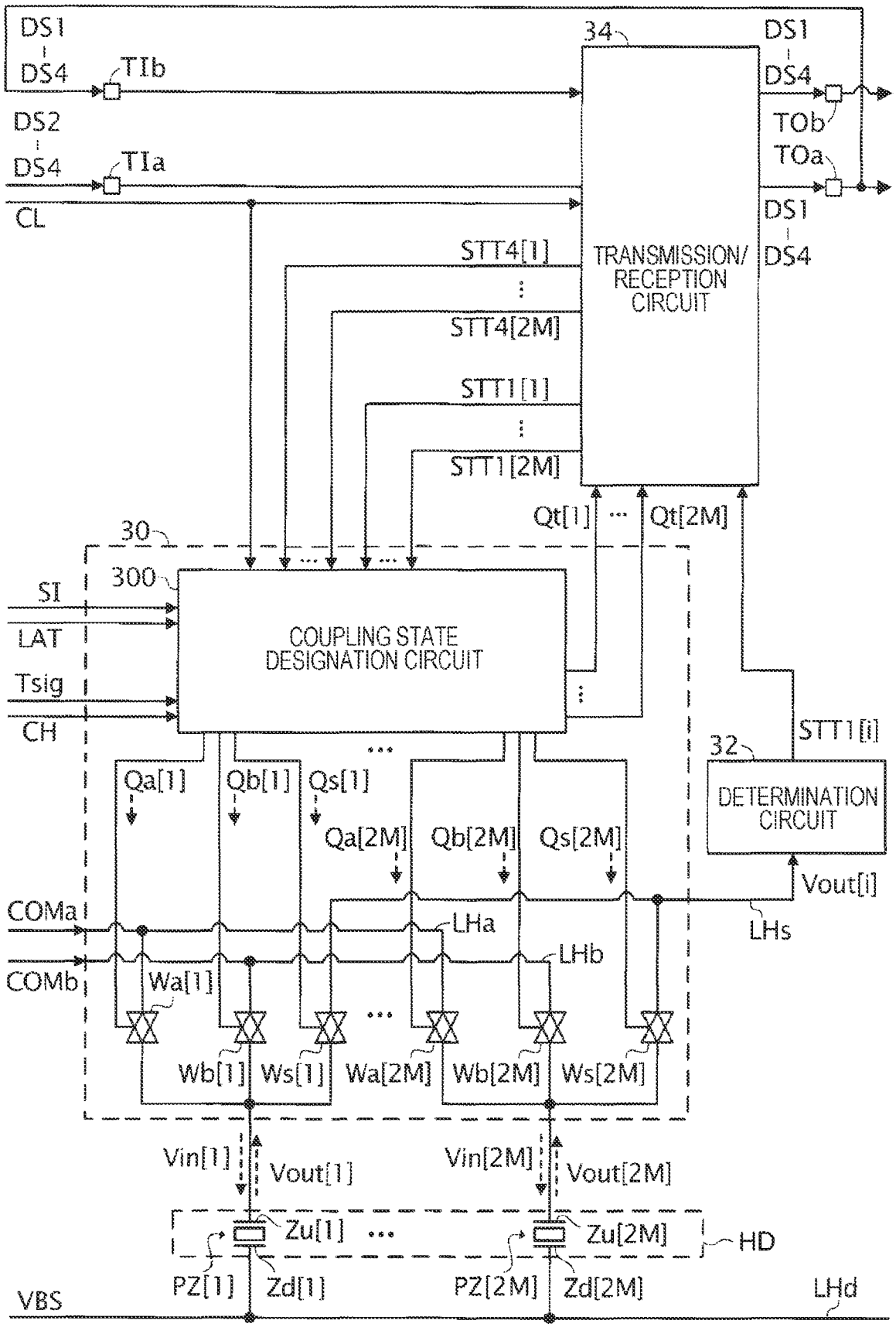
FIG. 8 is a block diagram illustrating a configuration of a head unit.

FIG. 8 is a block diagram illustrating a configuration of the head unit HU1. Configurations of the head units HU2, HU3, and HU4 are the same as the configuration of the head unit HU1. Therefore, description of the configurations of the head units HU2, HU3, and HU4 will be omitted.

As described in FIG. 1, the head unit HU1 includes the recording head HD, the switching circuit 30, the determination circuit 32, and the transmission/reception circuit 34. The head unit HU1 also includes a wiring LHa to which the drive signal COMa is supplied from the drive signal generation unit 4, a wiring LHb to which the drive signal COMb is supplied from the drive signal generation unit 4, a wiring LHs via which the detection signal Vout is supplied to the determination circuit 32, and a power supply line LHd set to a potential VBS. The power supply line LHd is coupled to a lower electrode Zd of a piezoelectric element PZ included in the ejection portion D.

The switching circuit 30 includes 2M switches Wa, 2M switches Wb, 2M switches Ws, and a coupling state designation circuit 300 that designates a coupling state of each switch W. As each switch W, for example, a transmission gate can be used.

The printing signal SI, a latch signal LAT, a change signal CH, a period designation signal Tsig, and a clock signal CL are supplied to the coupling state designation circuit 300 from the control unit 2. The determination information STT1[1] to STT1[2M] and the determination information STT4[1] to STT4[2M] for the head unit HU4 paired with the head unit HU1 are supplied to the coupling state designation circuit 300 from the transmission/reception circuit 34. The coupling state designation circuit 300 generates coupling state designation signals Qa[1] to Qa[2M], Qb[1] to Qb[2M], and Qs[1] to Qs[2M], and an inspection target designation signals Qt[1] to Qt[2M], based on at least some of the printing signal SI, the latch signal LAT, the change signal CH, the period designation signal Tsig, the clock signal CL, the determination information STT1[1] to STT1[2M], and the determination information STT4[1] to STT4[2M].

The coupling state designation signal Qa[i] is a signal for designating ON and OFF of the switch Wa[i]. The coupling state designation signal Qb[i] is a signal for designating ON and OFF of the switch Wb[i]. The coupling state designation signal Qs[i] is a signal for designating ON and OFF of the switch Ws[i]. The inspection target designation signal Qt[i] is a signal indicating whether or not the ejection portion D[i] is an inspection target related to an ejection state, and is supplied to the transmission/reception circuit 34.

The switch Wa[i] switches electrical coupling and decoupling between the wiring LHa and the upper electrode Zu[i] of the piezoelectric element PZ[i] included in the ejection portion D[i] based on the coupling state designation signal Qa[i]. Hereinafter, the upper electrode Zu[i] of the piezoelectric element PZ[i] included in the ejection portion D[i] may be referred to as the upper electrode Zu[i] of the ejection portion D[i]. For example, the switch Wa[i] is turned on when the coupling state designation signal Qa[i] has a high level, and thus electrically couples the wiring LHa to the upper electrode Zu[i] of the ejection portion D[i]. Consequently, the drive signal COMa supplied to the wiring LHa is supplied to the upper electrode Zu[i] of the ejection portion D[i] as the supply drive signal Vin[i]. The switch Wa[i] is turned off when the coupling state designation signal Qa[i] has a low level, and thus electrically decouples the wiring LHa from the upper electrode Zu[i] of the ejection portion D[i].

The switch Wb[i] switches electrical coupling and decoupling between the wiring LHb and the upper electrode Zu[i] of the ejection portion D[i] based on the coupling state designation signal Qb[i]. For example, the switch Wb[i] is turned on when the coupling state designation signal Qb[i] has a high level, and thus electrically couples the wiring LHb to the upper electrode Zu[i] of the ejection portion D[i]. Consequently, the drive signal COMb supplied to the wiring LHb is supplied to the upper electrode Zu[i] of the ejection portion D[i] as the supply drive signal Vin[i]. The switch Wb[i] is turned off when the coupling state designation signal Qb[i] has a low level, and thus electrically decouples the wiring LHb from the upper electrode Zu[i] of the ejection portion D[i].

The switch Ws[i] switches electrical coupling and decoupling between the wiring LHs and the upper electrode Zu[i] of the ejection portion D[i] based on the coupling state designation signal Qs[i]. For example, the switch Ws[i] is turned on when the coupling state designation signal Qs[i] has a high level, and thus electrically couples the wiring LHs to the upper electrode Zu[i] of the ejection portion D[i]. Consequently, the detection signal Vout[i] indicating a potential of the upper electrode Zu[i] of the ejection portion D[i] is supplied to the determination circuit 32 via the wiring LHs. The switch Ws[i] is turned off when the coupling state designation signal Qs[i] has a low level, and thus electrically decouples the wiring LHs from the upper electrode Zu[i] of the ejection portion D[i].

As described with reference to FIG. 1, the determination circuit 32 generates the remaining vibration signal based on the detection signal Vout[i] supplied via the wiring LHs. For example, the determination circuit 32 shapes the detection signal Vout[i] into a waveform suitable for a process of determining an ejection state by amplifying an amplitude of the detection signal Vout[i] and removing a noise component from the detection signal Vout[i]. Consequently, the remaining vibration signal shaped into the waveform suitable for the process of determining the ejection state is generated. For example, the determination circuit 32 may be configured to include a negative feedback amplifier amplifying the detection signal Vout, a low-pass filter attenuating a high frequency component of the detection signal Vout, and a voltage follower generating a low-impedance remaining vibration signal by converting an impedance.

The determination circuit 32 determines an ink ejection state in the ejection portion D[i] based on the remaining vibration signal obtained by shaping the detection signal Vout[i], and generates the determination information STT1[*i*] indicating the determination result. The determination circuit 32 supplies the determination information STT1[*i*] to the transmission/reception circuit 34.

As described in FIG. 1, the transmission/reception circuit 34 combines the data set DS1 including the determination information STT1 output from the determination circuit 32 with the data sets DS2, DS3, and DS4 supplied to the terminal TIa of the head unit HU1, and outputs the combined result to the terminal TOa of the head unit HU1. The transmission/reception circuit 34 outputs, for example, the data sets DS1, DS2, DS3, and DS4 supplied to the terminal TIb of the head unit HU1 to the terminal TOb of the head unit HU1.

Figure 9:
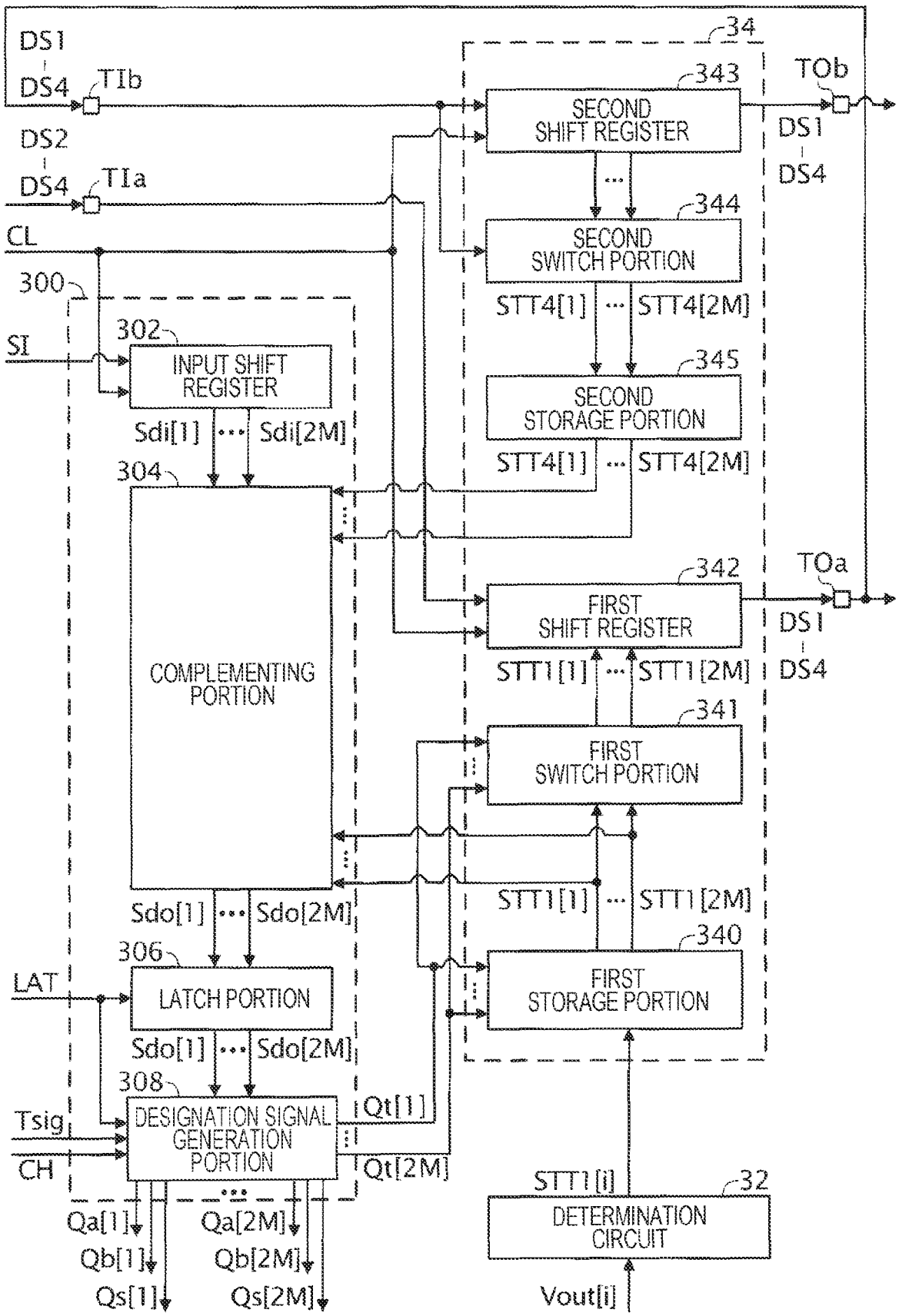
FIG. 9 is a block diagram illustrating configurations of a coupling state designation circuit and a transmission/reception circuit.

FIG. 9 is a block diagram illustrating configurations of the coupling state designation circuit 300 and the transmission/reception circuit 34. First, the coupling state designation circuit 300 will be described.

The coupling state designation circuit 300 includes an input shift register 302, a complementing portion 304, a latch portion 306, and a designation signal generation portion 308. In FIG. 9, an outline of the input shift register 302, the complementing portion 304, the latch portion 306, and the designation signal generation portion 308 will be described. Details of the input shift register 302 and the like will be described with reference to FIG. 12.

The input shift register 302 sequentially holds the individual designation signals Sdi[1] to Sdi[2M] serially supplied as the printing signal SI from the control unit 2 according to the clock signal CL. Consequently, the individual designation signals Sdi[1] to Sdi[2M] are held in the input shift register 302.

The complementing portion 304 generates the individual designation signal Sdo[1] to Sdo[2M] based on the individual designation signals Sdi[1] to Sdi[2M], the determination information STT1[1] to STT1[2M], and the determination information STT4[1] to STT4[2M]. The complementing portion 304 supplies the individual designation signals Sdo[1] to Sdo[2M] to the latch portion 306. For example, when all ejection states for the ejection portions D[1] to D[2M] of the head unit HU1 and the ejection portions D[1] to D[2M] of the head unit HU4 are normal, the individual designation signal Sdi[1] to Sdi[2M] are supplied from the complementing portion 304 to the latch portion 306 as individual designation signals Sdo[1] to Sdo[2M]. In other words, the complementing portion 304 adjusts ink ejection amounts in the plurality of ejection portions D based on the determination information STT1 supplied from the determination circuit 32 via the transmission/reception circuit 34 and the determination information STT4 supplied from the head unit HU4 via the data path PT41 and the transmission/reception circuit 34. For example, when the complementing portion 304 determines that ink ejection amounts in the plurality of ejection portions D are not changed based on the determination information STT4, the ejection amount adjustment includes not changing an ejection amount.

In the above-described way, the complementing portion 304 adjusts an ink ejection amount in the complementing ejection portion Dq among the 2M ejection portions D of the head unit HU1 based on the determination information STT4 received by the head unit HU1 from the head unit HU4 via the data path PT41, and thus complements the abnormal ejection portion Df among the 2M ejection portions D of the head unit HU4. For example, a complementary printing process in the complementing portion 304 may be executed prior to a complementary printing process in the control unit 2. In this case, the complementing portion 304 supplies the individual designation signals Sdi[1] to Sdi[2M] as the individual designation signals Sdo[1] to Sdo[2M] to the latch portion 306 after the complementary printing process is started by the control unit 2.

The latch portion 306 latches the individual designation signals Sdo[1] to Sdo[2M] supplied from the complementing portion 304 at a timing at which the latch signal LAT rises. The designation signal generation portion 308 generates the coupling state designation signals Qa[i], Qb[i], and Qs[i] and the inspection target designation signal Qt[i] based on the individual designation signal Sdo[i], the latch signal LAT, the change signal CH, and the period designation signal Tsig.

The transmission/reception circuit 34 includes a first storage portion 340, a first switch portion 341, a first shift register 342, a second shift register 343, a second switch portion 344, and a second storage portion 345. In FIG. 9, outlines of the first storage portion 340, the first switch portion 341, the first shift register 342, the second shift register 343, the second switch portion 344, and the second storage portion 345 will be described. Details of the first storage portion 340 and the like will be described with reference to FIG. 13.

The first storage portion 340 stores, for example, the determination information STT1[*i*] supplied from the determination circuit 32 based on the inspection target designation signal Qt[i]. For example, when ejection state inspection for the ejection portions D[1] to D[2M] of the head unit HU1 is finished, the first switch portion 341 supplies the determination information STT1[1] to STT1[2M] stored in the first storage portion 340 to the first shift register 342. In the example illustrated in FIG. 9, the first switch portion 341 determines a timing at which the determination information STT1[1] to STT1[2M] is supplied to the first shift register 342 based on the inspection target designation signals Qt[1] to Qt[2M].

The first shift register 342 sequentially outputs the determination information STT1[1] to STT1[2M] according to the clock signal CL. Consequently, the data set DS1 including the determination information STT1[1] to STT1[2M] is supplied to the terminal TOa of the head unit HU1. The first shift register 342 sequentially outputs the data sets DS2 to DS4 serially supplied to the terminal TIa of the head unit HU1 according to the clock signal CL. In other words, the first shift register 342 serially supplies the data sets DS1 to DS4 to the terminal TOa of the head unit HU1 according to the clock signal CL.

The second shift register 343 serially supplies the data sets DS1 to DS4 serially supplied to the terminal TIb of the head unit HU1, to the terminal TOb of the head unit HU1 according to the clock signal CL. In the example illustrated in FIG. 9, the data sets DS1 to DS4 are supplied to the terminals TIb of the head unit HU1 from the first shift register 342 via the terminal TOa of the head unit HU1 and the wiring WL11. In other words, the data set DS1 of the head unit HU1 and the data sets DS2 to DS4 supplied to the terminal TIa of the head unit HU1 are supplied to the terminal TIb of the head unit HU1. The transmission of the data sets DS1 to DS4 from the first shift register 342 of the head unit HU1 to the second shift register 343 of the head unit HU1 may be performed in the head unit HU1 without passing through the terminals TOa and TIb of the head unit HU1.

For example, the second switch portion 344 supplies the determination information STT4[1] to STT4[2M] included in the data set DS4 of the head unit HU4 paired with the head unit HU1 to the second storage portion 345. In the example illustrated in FIG. 9, the second switch portion 344 determines a timing at which the determination information STT4[1] to STT4[2M] are supplied to the second storage portion 345 based on the recording head information INFhd4 included in the data set DS4 supplied to the second shift register 343. The second storage portion 345 stores the determination information STT4[1] to STT4[2M] supplied from the second shift register 343 via the second switch portion 344. In other words, the second storage portion 345 stores the determination information STT4[1] to STT4[2M] received by the head unit HU1 from the head unit HU4 via the data path PT41. The second storage portion 345 is an example of a "storage portion".

Configurations of the coupling state designation circuit 300 and the transmission/reception circuit 34 are not limited to the example illustrated in FIG. 9. For example, a signal for designating a timing of supplying the determination information STT1[1] to STT1[2M] to the first shift register 342 may be supplied from the control unit 2 or the like to the first switch portion 341.

Figure 10:
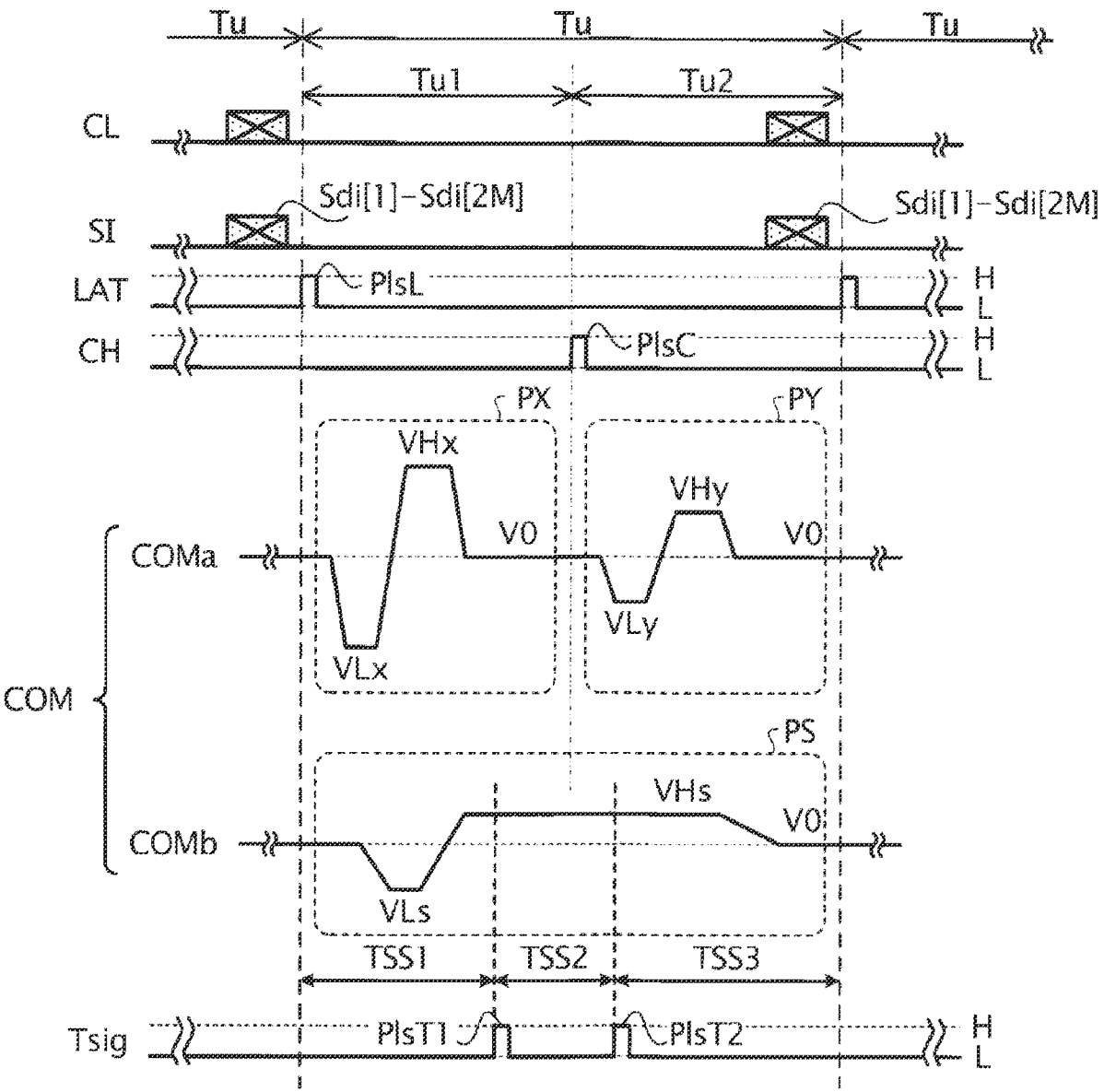
FIG. 10 is a timing chart illustrating an example of the operation of the ink jet printer.

FIG. 10 is a timing chart illustrating an example of an operation of the ink jet printer 1. In the present embodiment, when the ink jet printer 1 executes the printing process, one or a plurality of unit periods Tu are set as an operation period of the ink jet printer 1. The ink jet printer 1 according to the present embodiment may drive each ejection portion D in order to perform the printing process in each unit period Tu.

The control unit 2 outputs the latch signal LAT having a pulse PlsL and the change signal CH having a pulse PlsC. Consequently, the control unit 2 defines the unit period Tu as a period from rising of the pulse PlsL to rising of the next pulse PlsL. The control unit 2 divides the unit period Tu into two control periods Tu1 and Tu2 with the pulse PlsC.

The printing signal SI includes, for example, 2M individual designation signals Sdi[1] to Sdi[2M] respectively corresponding to the 2M ejection portions D[1] to D[2M]. The individual designation signal Sdi[i] designates an aspect of driving of the ejection portion D[i] in each unit period Tu when the ink jet printer 1 executes the printing process. When the complementary printing process is executed, an aspect of driving of the ejection portion D[i] is designated by the individual designation signal Sdi[i] and the individual designation signal Sdo[i] that is generated based on the determination information STT.

The control unit 2 supplies the printing signal SI including the individual designation signals Sdi[1] to Sdi[2M] to the coupling state designation circuit 300 in synchronization with the clock signal CL before each unit period Tu in which the printing process is executed. The coupling state designation circuit 300 generates the coupling state designation signals Qa[i], Qb[i] and Qs[i], and the inspection target designation signal Qt[i] based on the individual designation signal Sdi[i] in the unit period Tu.

In the present embodiment, a case is assumed in which the ejection portion D[i] can form one of a large dot, a medium dot smaller than the large dot, and a small dot smaller than the medium dot in the unit period Tu. Hereinafter, an amount of ink corresponding to a large dot may be referred to as a large amount of ink, an amount of ink corresponding to a medium dot may be referred to as a medium amount of ink, and an amount of ink corresponding to a small dot may be referred to as a small amount of ink.

For example, the individual designation signal Sdi[i] designates one driving aspect among five driving aspects such as ejection of a large amount of ink, ejection of a medium amount of ink, ejection of a small amount of ink, non-ejection of ink, and driving that is a determination target when an ejection state is determined in each unit period Tu for the ejection portion D[i]. In the present embodiment, in an example, a case is assumed in which the individual designation signal Sd[i] is a 3-bit digital signal. An example of the relationship between the 3-bit digital signal of the individual designation signal Sd[i] and a designated content is illustrated in FIG. 11 described later.

As illustrated in FIG. 10, the drive signal generation unit 4 outputs the drive signal COMa having a waveform PX and a waveform PY. The waveform PX is a waveform of the drive signal COMa in the control period Tu1, and the waveform PY is a waveform of the drive signal COMa in the control period Tu2.

In the present embodiment, the waveform PX and the waveform PY are set such that a potential difference between the highest potential VHx and the lowest potential VLx of the waveform PX is larger than a potential difference between the highest potential VHy and the lowest potential VLy of the waveform PY. Specifically, when the ejection portion D[i] is driven by the drive signal COMa having the waveform PX, the waveform PX is set such that a medium amount of ink is ejected from the ejection portion D[i]. When the ejection portion D[i] is driven by the drive signal COMa having the waveform PY, the waveform PY is set such that a small amount of ink is ejected from the ejection portion D[i]. The potentials at the start and the end of the waveforms PX and PY are set to a reference potential VO.

When the individual designation signal Sd[i] designates the ejection portion D[i] to form a large dot, the coupling state designation circuit 300 sets the coupling state designation signal Qa[i] to a high level in the control periods Tu1 and Tu2, and sets the coupling state designation signals Qb[i] and Qs[i] to a low level in the unit period Tu. In this case, the ejection portion D[i] is driven by the drive signal COMa having the waveform PX in the control period Tu1 to eject a medium amount of ink, and is driven by the drive signal COMa having the waveform PY in the control period Tu2 to eject a small amount of ink. Consequently, the ejection portion D[i] ejects a large amount of ink in total in the unit period Tu, and thus a large dot is formed on the recording paper P.

When the individual designation signal Sd[i] designates the ejection portion D[i] to form a medium dot, the coupling state designation circuit 300 sets the coupling state designation signal Qa[i] to a high level in the control period Tu1 and to a low level in the control period Tu2, and sets the coupling state designation signals Qb[i] and Qs[i] to a low level in the unit period Tu. In this case, the ejection portion D[i] ejects a medium amount of ink in the unit period Tu, and thus a medium dot is formed on the recording paper P.

When the individual designation signal Sd[i] designates the ejection portion D[i] to form a small dot, the coupling state designation circuit 300 sets the coupling state designation signal Qa[i] to a low level in the control period Tu1 and to a high level in the control period Tu2, and sets the coupling state designation signals Qb[i] and Qs[i] to a low level in the unit period Tu. In this case, the ejection portion D[i] ejects a small amount of ink in the unit period Tu, and thus a small dot is formed on the recording paper P.

When the individual designation signal Sd[i] designates the ejection portion D[i] to perform non-ejection of ink, the coupling state designation circuit 300 sets the coupling state designation signals Qa[i], Qb[i], and Qs[i] to a low level in the unit period Tu. In this case, the ejection portion D[i] does not eject ink and thus does not form dots on the recording paper P in the unit period Tu.

The drive signal generation unit 4 outputs the drive signal COMb having a waveform PS. The waveform PS is a waveform of the drive signal COMb in the unit period Tu. In the present embodiment, the waveform PS is set such that a potential difference between the highest potential VHs and the lowest potential VLs of the waveform PS is smaller than a potential difference between the highest potential VHy and the lowest potential VLy of the waveform PY. Specifically, when the drive signal COMb having the waveform PS is supplied to the ejection portion D[i], the waveform PS is set to drive the ejection portion D[i] such that ink is not ejected from the ejection portion D[i]. Potentials at the start and the end of the waveform PS are set to the reference potential VO.

The control unit 2 outputs the period designation signal Tsig having a pulse PlsT1 and a pulse PlsT2. Consequently, the control unit 2 divides the unit period Tu into a control period TSS1 from the start of the pulse PlsL to the start of the pulse PlsT1, a control period TSS2 from the start of the pulse PlsT1 to the start of the pulse PlsT2, and a control period TSS3 from the start of the pulse PlsT2 to the start of the next pulse PlsL.

When the individual designation signal Sd[i] designates the ejection portion D[i] as the determination target ejection portion D, the coupling state designation circuit 300 sets the coupling state designation signal Qa[i] to a low level in the unit period Tu, sets the coupling state designation signal Qb[i] to a high level in the control periods TSS1 and TSS3 and to a low level in the control period TSS2, and sets the coupling state designation signal Qs[i] to a low level in the control periods TSS1 and TSS3 and to a high level in the control period TSS2.

In this case, the determination target ejection portion D is driven by the drive signal COMb having the waveform PS in the control period TSS1. Specifically, the piezoelectric element PZ included in the determination target ejection portion D is displaced by the drive signal COMb having the waveform PS in the control period TSS1. As a result, vibration occurs in the determination target ejection portion D. The vibration occurring in the control period TSS1 remains in the control period TSS2. In the control period TSS2, the upper electrode Zu of the piezoelectric element PZ included in the determination target ejection portion D changes a potential according to the remaining vibration occurring in the determination target ejection portion D. In other words, in the control period TSS2, the upper electrode Zu of the piezoelectric element PZ included in the determination target ejection portion D indicates a potential corresponding to an electromotive force of the piezoelectric element PZ caused by the remaining vibration occurring in the determination target ejection portion D. The potential of the upper electrode Zu may be detected as the detection signal Vout in the control period TSS2.

FIG. 11 is an explanatory diagram for describing generation of the coupling state designation signals Qa[i], Qb[i], and Qs[i] in the designation signal generation portion 308. As described with reference to FIG. 10, the individual designation signal Sdo[i] designates a driving aspect of the ejection portion D[i] by using three bits such as b1, b2, and b3. In the present embodiment, among the bits b1, b2, and b3, it is assumed that the bit b1 is the most significant bit and the bit b3 is the least significant bit. When all ejection states of the ejection portions D[1] to D[2M] are normal, the individual designation signal Sdo[i] is set to the same value as that of the individual designation signal Sdi[i] included in the printing signal SI.

The individual designation signal Sdo[i] has a value among a value (1, 1, 0) for designating formation of a large dot, a value (1, 0, 0) for designating formation of a medium dot, a value (0, 1, 0) for designating formation of a small dot, a value (0, 0, 0) for designating non-ejection of ink, and a value (1, 1, 1) for designating driving of the ejection portion D that is a determination target. The designation signal generation portion 308 sets the coupling state designation signal Qa[i] to a high level in the control periods Tu1 and Tu2 when the individual designation signal Sdo[i] has the value (1, 1, 0), and sets the coupling state designation signal Qa[i] to a high level in the control period Tu1 when the individual designation signal Sdo[i] has the value (1, 0, 0). The designation signal generation portion 308 sets the coupling state designation signal Qa[i] to a high level in the control period Tu2 when the individual designation signal Sdo[i] has the value (0, 1, 0), and sets the coupling state designation signal Qb[s] to a high level in the control periods TSS1 and TSS3 and sets the coupling state designation signal Qs[i] to a high level in the control period TSS2 when the individual designation signal Sdo[i] has the value (1, 1, 1). The designation signal generation portion 308 sets each signal to a low level when the above conditions are not satisfied.

Figure 12:
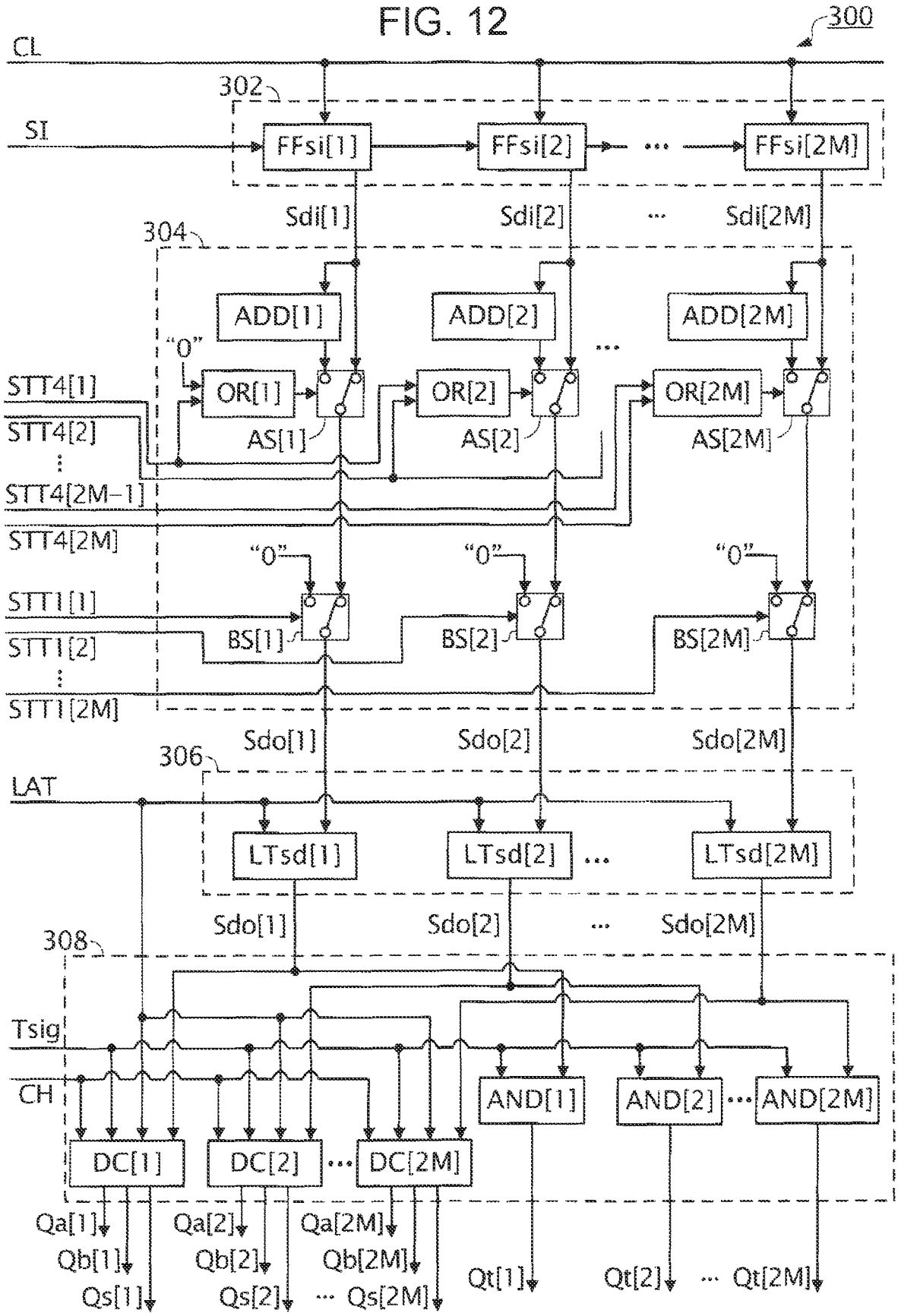
FIG. 12 is a diagram illustrating an example of a circuit configuration of a coupling state designation circuit.

FIG. 12 is a diagram illustrating an example of a circuit configuration of the coupling state designation circuit 300. The coupling state designation circuit 300 illustrated in FIG. 12 is an example of the coupling state designation circuit 300 of the head unit HU1. The coupling state designation circuit 300 includes the input shift register 302, the complementing portion 304, the latch portion 306, and the designation signal generation portion 308, as described in FIG. 9.

The input shift register 302 has, for example, 2M holding circuits FFsi coupled in cascade. As the holding circuit FFsi, for example, flip-flop circuits may be used.

Among the holding circuits FFsi[1] to FFsi[2M], the holding circuits FFsi[1] to FFsi[2M−1] sequentially transmit the printing signal SI to the holding circuit FFsi in the subsequent stage according to the clock signal CL. For example, the 3-bit individual designation signal Sdi is serially supplied as the printing signal SI from the control unit 2 to the first-stage holding circuit FFsi[1] in synchronization with the clock signal CL. The holding circuit FFsi[1] temporarily holds the 3-bit individual designation signal Sdi and sequentially transmits the individual designation signal Sdi to the holding circuit FFsi[2] in the subsequent stage according to the clock signal CL. Similarly, the holding circuits FFsi[2] to FFsi[2M−1] temporarily hold the 3-bit individual designation signal Sdi transmitted from the holding circuit FFsi in the previous stage, and sequentially transmit the individual designation signal Sdi to the holding circuit FFsi in the subsequent stage according to the clock signal CL. The individual designation signal Sdi is transmitted to the holding circuit FFsi[2M] in the final stage such that the holding circuit FFsi[i] temporarily holds the 3-bit individual designation signal Sdi[i].

The complementing portion 304 has 2M adder circuits ADD, 2M logical sum circuits OR, 2M switches AS, and 2M switches BS. The adder circuit ADD[i] adds a result of exclusive OR of the upper 2 bits of the individual designation signal Sdi[i] to the 3-bit individual designation signal Sdi[i] held in the holding circuit FFsi[i], and supplies a 3-bit signal indicating the addition result to the switch AS[i].

The switch AS[i] supplies one of the 3-bit individual designation signal Sdi[i] held in the holding circuit FFsi[i] and the 3-bit signal supplied from the adder circuit ADD[i] to the switch BS[i] based on the signal supplied from the logical sum circuit OR[i]. For example, the switch AS[i] supplies the 3-bit signal supplied from the adder circuit ADD[i] to the switch BS[i] when the signal supplied from the logical sum circuit OR[i] indicates "1". The switch AS[i] supplies the 3-bit individual designation signal Sdi[i] to the switch BS[i] when the signal supplied from the logical sum circuit OR[i] indicates "0".

The logical sum circuit OR[1] supplies a signal indicating a result of s logical sum of "0" and the determination information STT4[1] to the switch AS[1]. Each logical sum circuit OR[i] of the logical sum circuits OR[2] to OR[2M] supplies a signal indicating a result of a logical sum of the determination information STT4[*i*−1] and the determination information STT4[*i*] to the switch AS[i].

In other words, the signal supplied from the logical sum circuit OR[i] to the switch AS[i] is used to control whether or not an ink ejection amount in the ejection portion D[i] is increased from an ink ejection amount defined by the individual designation signal Sdi[i] based on the printing data IMG. For example, when the determination information STT4[*i*] indicates abnormal ejection, the signal supplied from the logical sum circuit OR[i] to the switch AS[i] indicates that an ink ejection amount in the ejection portion D[i] of the head unit HU1 is increased from an ink ejection amount defined by the individual designation signal Sdi[i]. The signal supplied from the logical sum circuit OR[i] to the switch AS[i] is an example of a "complementary control signal". The logical sum circuits OR[1] to OR[2M] are examples of "signal generation portions".

When the individual designation signal Sdi[i] designates formation of a large dot, an ink ejection amount in the ejection portion D[i] of the head unit HU1 is not increased from an ink ejection amount defined by the individual designation signal Sdi[i]. In the example illustrated in FIG. 12, in a case where the individual designation signal Sdi[i] for the head unit HU1 designates non-ejection of ink even when the determination information STT4[*i*] indicates abnormal ejection, an ink ejection amount in the ejection portion D[i] of the head unit HU1 is not increased from an ink ejection amount defined by the individual designation signal Sdi[i]. Even in a case where the individual designation signal Sdi[i] for the head unit HU1 designates non-ejection of ink when the determination information STT4[*i*] indicates abnormal ejection, an ink ejection amount in the ejection portion D[i] of the head unit HU1 may be increased from an ink ejection amount defined by the individual designation signal Sdi[i].

The switch BS[i] supplies one of the 3-bit signal supplied from the switch AS[i] and the signal indicating "0" to the latch circuit LTsd[i] included in the latch portion 306 as a 3-bit individual designation signal Sdo[i] based on the determination information STT1[*i*]

The latch portion 306 has 2M latch circuits LTsd. The latch circuit LTsd[i] latches the 3-bit individual designation signal Sdo[i] supplied from the switch BS[i] at a timing when the latch signal LAT rises. The latch circuit LTsd[i] supplies the latched 3-bit individual designation signal Sdo [i] to a decoder DC[i] and a logical product circuit AND[i] included in the designation signal generation portion 308.

The designation signal generation portion 308 has 2M decoders DCs and 2M logical product circuits AND. The decoder DC[i] generates the coupling state designation signals Qa[i] and Qb[i] And Qs[i] based on the 3-bit individual designation signal Sdo[i], the latch signal LAT, the change signal CH, and the period designation signal Tsig. The logical product circuit AND[i] generates the inspection target designation signal Qt[i] by calculating a logical product of the period designation signal Tsig and the 3-bit individual designation signal Sdo[i].

Here, a circuit configuration of the coupling state designation circuit 300 of each of the head units HU2 to HU4 is the same as that of the coupling state designation circuit 300 of the head unit HU1 except for the determination information STT supplied to the complementing portion 304. However, in the head units HU3 and HU4, "0" is supplied to the logical sum circuit OR[2M] instead of the logical sum circuit OR[1]. For example, in the head unit HU4, each logical sum circuit OR[i] of the logical sum circuits OR[1] to OR[2M−1] supplies a signal indicating a result of a logical sum of the determination information STT1[*i*] and the determination information STT1[*i*+1] to the switch AS[i], and the logical sum circuit OR[2M] supplies a signal indicating a result of a logical sum of "0" and the determination information STT1[2M] to the switch AS[2M].

A circuit configuration of the coupling state designation circuit 300 is not limited to the example illustrated in FIG. 12. For example, when there is one complementing ejection portion Dq for one abnormal ejection portion Df, the logical sum circuits OR[1] to OR[2M] may be omitted. In this case, for example, the determination information STT4[*i*] may be supplied to the switch AS[i]. For example, when there is one complementing ejection portion Dq for one abnormal ejection portion Df, the complementing portion 304 may include a switch that alternately switches the determination information STT4 supplied to the switch AS[i] between the determination information STT4[*i*−1] and the determination information STT4[*i*] instead of the logical sum circuit OR[i].

Figure 13:
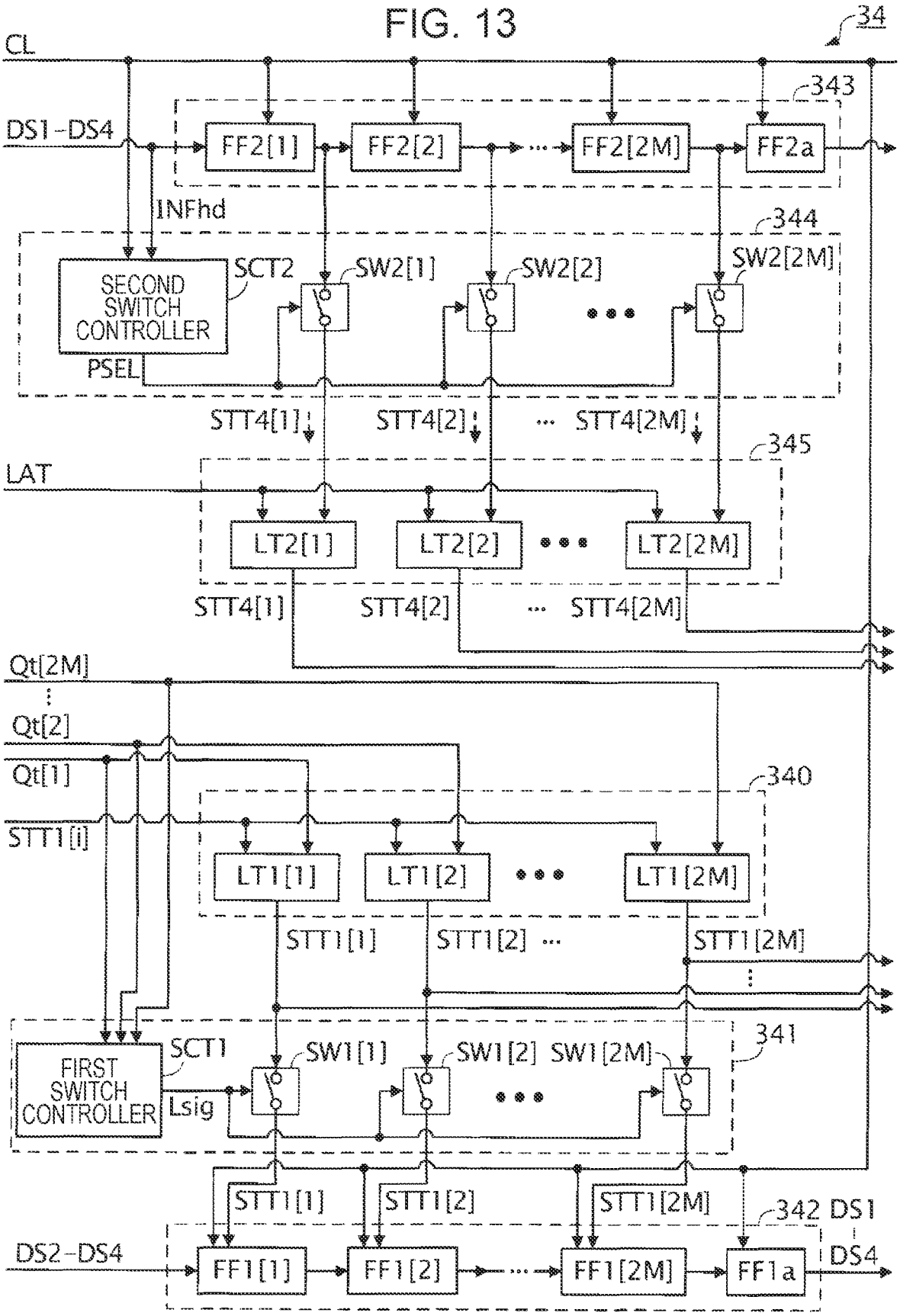
FIG. 13 is a diagram illustrating an example of a circuit configuration of a transmission/reception circuit.

FIG. 13 is a diagram illustrating an example of a circuit configuration of the transmission/reception circuit 34. The transmission/reception circuit 34 illustrated in FIG. 13 is an example of the transmission/reception circuit 34 of the head unit HU1. As described with reference to FIG. 9, the transmission/reception circuit 34 includes the first storage portion 340, the first switch portion 341, the first shift register 342, the second shift register 343, the second switch portion 344, and the second storage portion 345.

The first storage portion 340 has 2M latch circuits LT1. The latch circuit LT1[*i*] latches the determination information STT1 as the determination information STT1[*i*] at the timing when the inspection target designation signal Qt[i] rises. The latch circuit LT1[*i*] supplies the latched determination information STT1[*i*] to the switch BS[i] of the coupling state designation circuit 300. The latch circuit LT1[*i*] supplies the latched determination information STT1[*i*] to the switch SW1[*i*] included in the first switch portion 341.

The first switch portion 341 has a first switch controller SCT1 and 2M switches SW1. The first switch controller SCT1 generates a switch control signal Lsig based on, for example, the inspection target designation signals Qt[1] to Qt[2M]. For example, the first switch controller SCT1 has 2M determination flags respectively corresponding to the inspection target designation signals Qt[1] to Qt[2M], and, whenever the inspection target designation signal Qt indicating "1" is supplied, the determination flag corresponding to the inspection target designation signal Qt is set to "1". When all of the 2M determination flags are set to "1", the first switch controller SCT1 sets the switch control signal Lsig to a high level, and sets the switch control signal Lsig to a low level after a predetermined time elapses from setting of the switch control signal Lsig to the high level. For example, the first switch controller SCT1 sets the switch control signal Lsig to a low level before the data set DS2 is supplied to the holding circuit FF1[1] described later. The first switch controller SCT1 resets the 2M determination flags to "0" when all of the 2M determination flags are set to "1".

The switch SW1[*i*] is turned on when the switch control signal Lsig has a high level, and supplies the determination information STT1[*i*] supplied from the latch circuit LT1[*i*] to the holding circuit FF1 included in the first shift register 342. The switch SW1[*i*] is turned off when the switch control signal Lsig has a low level, and thus electrically decouples, for example, the latch circuit LT1[*i*] to the holding circuit FF1[*i*].

The first shift register 342 includes, for example, "2M+a" holding circuits FF1 coupled in cascade. "a" is, for example, the number of holding circuits FF1 required to hold the recording head information INFhd included in the data set DS. In FIG. 13, the a holding circuits FF1 are illustrated as holding circuits FF1*a*. As the holding circuit FF1, for example, a flip-flop circuit may be used.

The holding circuit FF1[*i*] holds the determination information STT1[*i*] supplied from the switch SW1[*i*] before the data set DS2 is supplied to the holding circuit FF1[1]. The transmission/reception circuit 34 holds the recording head information INFhd1 in the holding circuit FF1*a* before the data set DS2 is supplied to the holding circuit FF1[1]. The holding circuit FF1[*i*] and the holding circuit FF1*a* sequentially transmit the held information to the holding circuit FF1 in the subsequent stage according to the clock signal CL. The holding circuit FF1*a* in the final stage sequentially transmits the information supplied from the previous-stage holding circuit FF1 in synchronization with the clock signal CL to the terminal TOa of the head unit HU1 according to the clock signal CL. Consequently, the data set DS1 is supplied to the terminal TOa of the head unit HU1.

Here, the first shift registers 342 of the other head units HU also operate similarly to the first shift register 342 of the head unit HU1. Therefore, the data sets DS2 to DS4 are serially supplied from the transmission/reception circuit 34 of the head unit HU2 to the holding circuit FF1[1] of the head unit HU1 in synchronization with the clock signal CL.

The holding circuit FF1[1] temporarily holds the data sets DS2 to DS4 supplied serially in synchronization with the clock signal CL, and sequentially transmits the data sets DS2 to DS4 to the holding circuit FF1[2] in the subsequent stage according to the clock signal CL. Similarly, the holding circuits FF1[2] to FF1[2M] and the holding circuit FF1*a* temporarily hold the information transmitted from the holding circuit FF1 in the previous stage and sequentially transmit the information to the holding circuit FF1 in the subsequent stage according to the clock signal CL. Consequently, the data sets DS2 to DS4 are supplied to the terminal TOa of the head unit HU1 after the data set DS1.

As described above, in the head unit HU1 according to the present embodiment, transmission of the determination information STT1 to the other head units HU is not executed whenever determination for one ejection portion D among the ejection portions D[1] to D[2M] is finished but is executed when determination for all of the ejection portions D[1] to D[2M] is finished.

Here, a predetermined process may be executed before and after a determination process such that a transmission process of transmitting the determination information STT1 to another head unit HU and the like and the determination process of determining an ink ejection state in the ejection portion D do not interfere with each other. In this case, the number of times of execution of the predetermined process increases as the number of times of execution of the transmission process increases. As the number of times of execution of the predetermined process increases, the processing time required to transmit the determination information STT1 for all the ejection portions D increases. In the present embodiment, compared with a case where the determination information STT1 is transmitted to another head unit HU whenever determination for one ejection portion D among the ejection portions D[1] to D[2M] is finished, the number of times of execution of the transmission process is can be reduced, and thus it is possible to reduce the time required for a series of processes for transmitting the determination information STT1 for all of the ejection portions D.

The second shift register 343 has, for example, "2M+α" holding circuits FF2 coupled in cascade. Here, "α" is, for example, the number of holding circuits FF2 required to hold the recording head information INFhd included in the data set DS. In FIG. 13, the a holding circuits FF2 are illustrated as the holding circuits FF2*a*. As the holding circuit FF2, for example, a flip-flop circuit may be used.

The data sets DS1 to DS4 that are supplied to the terminal TIb of the head unit HU1 in synchronization with the clock signal CL are serially supplied to the holding circuit FF2[1]. The holding circuit FF2[1] temporarily holds the data sets DS1 to DS4 serially supplied in synchronization with the clock signal CL, and sequentially transmits the data sets DS1 to DS4 to the holding circuit FF2[2] in the subsequent stage according to the clock signal CL. Similarly, the holding circuits FF2[2] to FF2[2M] and the holding circuit FF2*a* temporarily hold the information transmitted from the holding circuit FF2 in the previous stage, and sequentially transmit the information to the holding circuit FF2 in the subsequent stage according to the clock signal CL. The holding circuit FF2*a* in the final stage sequentially transmits the information supplied from the holding circuit FF2 in the previous stage in synchronization with the clock signal CL, to the terminal TOb of the head unit HU1 according to the clock signal CL. Consequently, the data sets DS1 to DS4 are supplied to the terminal TOa of the head unit HU1.

The second switch portion 344 has a second switch controller SCT2 and 2M switches SW2. The second switch controller SCT2 generates, for example, a switch control signal PSEL based on the recording head information INFhd4 included in the data set DS4. For example, the second switch controller SCT2 analyzes the recording head information INFhd included in the data set DS supplied to the holding circuit FF2[1], and determines whether or not the data set DS supplied to the holding circuit FF2[1] is the data set DS4 for the head unit HU4 paired with the head unit HU1.

When the data set DS4 is supplied to the holding circuit FF2[1], the second switch controller SCT2 specifies a timing at which the determination information STT4[1] to STT4[2M] are held in the holding circuits FF2[1] to FF2[2M] based on the recording head information INFhd4 included in the data set DS4. For example, the second switch controller SCT2 sets the switch control signal PSEL to a high level in accordance with a timing at which the determination information STT4[1] to STT4[2M] is transmitted from the holding circuits FF2[1] to FF2[2M] to the holding circuit FF2 in the subsequent stage. For example, the second switch controller SCT2 sets the switch control signal PSEL to the high level, and then sets the switch control signal PSEL to a low level according to the clock signal CL.

The switch SW2[*i*] is turned on when the switch control signal PSEL has a high level, and thus supplies the determination information STT4[*i*] supplied from the holding circuit FF2[*i*] to the latch circuit LT2[*i*] included in the second storage portion 345. The switch SW2[*i*] is turned off when the switch control signal PSEL has a low level, and thus electrically decouples, for example, the latch circuit LT2[*i*] from the holding circuit FF2[*i*].

The second storage portion 345 has 2M latch circuits LT2. The latch circuit LT2[*i*] latches the determination information STT4[*i*] supplied from the switch SW2[*i*] at a timing when the latch signal LAT rises. The latch circuit LT2[*i*] supplies the latched determination information STT4[*i*] to the complementing portion 304 of the coupling state designation circuit 300.

A circuit configuration of each of the transmission/reception circuits 34 of the head units HU2 to HU4 is the same as that of the transmission/reception circuit 34 of the head unit HU1.

A circuit configuration of the transmission/reception circuit 34 is not limited to the example illustrated in FIG. 13. For example, the switch control signal Lsig may be supplied from the control unit 2 or the like to the switches SW1[1] to SW[2M]. In this case, the first switch controller SCT1 may be omitted. For example, when the data set DS does not include the recording head information INFhd4, the holding circuit FF1*a* and the holding circuit FF2*a* may be omitted. For example, the second storage portion 345 may be provided in the coupling state designation circuit 300.

For example, the second storage portion 345 may be omitted when the coupling state designation circuit 300 has a logical sum result storage portion that stores logical sum results from logical sum circuits OR[1] to OR[2M]. In this case, the second shift register 343 may store the determination information STT4[1] to STT4[2M], for example, until the logical sum results from the logical sum circuit OR[1] to OR[2M] are stored in the logical sum result storage portion. In this case, the second shift register 343 corresponds to a "storage portion".

As described above, in the present embodiment, the ink jet printer 1 includes the head unit HU1 having the plurality of ejection portions D, the head unit HU2 having the plurality of ejection portions D, the head unit HU3 having the plurality of ejection portions D, the head unit HU4 having the plurality of ejection portions D, the control unit 2 controlling each head unit HU, and the data paths PT14 and PT41. The data path PT14 is used to transmit the data set DS1 including the determination information STT1 indicating whether or not ink ejection states in the plurality of ejection portions D included in the head unit HU1 are abnormal from the head unit HU1 to the head unit HU4 without passing through the control unit 2. The data path PT41 is used to transmit the data set DS4 including the determination information STT4 indicating whether or not ink ejection states in the plurality of ejection portions D included in the head unit HU4 are abnormal from the head unit HU4 to the head unit HU1 without passing through the control unit 2.

Therefore, in the present embodiment, the determination information STT for each head unit HU can be transmitted to another head unit HU without passing through the control unit 2. Consequently, in the present embodiment, for example, it is possible to reduce the time until the determination information STT4 is supplied from the head unit HU4 to the head unit HU1 compared with a case where the determination information STT4 for the head unit HU4 is transmitted to the control unit 2, and then the determination information STT4 is supplied again from the control unit 2 to the head unit HU1. As a result, in the present embodiment, a timing at which the head unit HU1 starts the complementary process based on the determination information STT4 can be made earlier than when the determination information STT4 is supplied from the control unit 2 to the head unit HU1. In other words, in the present embodiment, the cooperation among the plurality of head units HU can be performed at a high speed based on the determination information STT indicating a determination result for the ejection portion D included in each of the plurality of head units HU.

In the present embodiment, for example, compared with a case where the determination information STT4 for the head unit HU4 is transmitted to the control unit 2, and then the determination information STT4 is supplied again from the control unit 2 to the head unit HU1, the data path PT41 via which the determination information STT4 is transmitted from the head unit HU4 to the head unit HU1 can be reduced. For example, in the present embodiment, compared with a transmission path via which the determination information STT4 is supplied from the control unit 2 to the head unit HU1, for example, the data path PT41 can be reduced by a round-trip transmission path from the head unit HU1 to the control unit 2.

When a transmission path for the determination information STT is short, the influence of noise on the transmission path for the determination information STT is reduced more than when the transmission path for the determination information STT is long. Therefore, when the transmission path for the determination information STT is short, the risk of the determination information STT changing to erroneous information due to noise during transmission of the determination information STT is reduced more than when the transmission path of the determination information STT is long. In other words, in the present embodiment, it is possible to reduce the risk that the complementary process based on the erroneous determination information STT is executed.

In the present embodiment, each head unit HU has the complementing portion 304 that adjusts an ink ejection amount in the ejection portion D included in the paired head unit HU based on the determination information STT received from the paired head units HU. Consequently, in the present embodiment, for example, even when the abnormal ejection occurs in the ejection portion D included in the head unit HU4 paired with the head unit HU1, a complementary printing process can be executed by the head unit HU1 based on the determination information STT4 transmitted from the head unit HU4 to the head unit HU1 via the data path PT41.

For example, in the present embodiment, each head unit HU has the second storage portion 345 that stores the determination information STT received from the paired head unit HU. In the present embodiment, each head unit HU has the logical sum circuit OR[i] that generates, based on the determination information STT, the complementary control signal for controlling whether or not an ink ejection amount in the ejection portion D[i] is increased from an ink ejection amount defined by the individual designation signal Sdi[i] based on the printing data IMG. For example, when the determination information STT4[*i*] indicates that an ink ejection state in the ejection portion D[i] of the head unit HU4 is abnormal, the complementary control signal indicates that an ink ejection amount in the complementing ejection portion Dq among the plurality of ejection portions D of the head unit HU1 is increased from an ink ejection amount based on the printing data IMG. As described above, in the present embodiment, the complementary printing process can be executed by the head unit HU based on the determination information STT.

2. MODIFICATION EXAMPLES

Each of the above forms can be variously modified. Specific modification aspects will be exemplified below. Two or more aspects freely selected from the following exemplifications may be combined with each other as appropriate within the scope in which the aspects are not contradictory to each other. In the modification examples described below, an element having the same operation or function as that in the embodiment will be given the reference numeral used in the above description, and detailed description thereof will be omitted as appropriate.

Modification Example 1

In the above-described embodiment, a description has been made of an example of a case where the determination circuit 32 determines the determination target ejection portions D one by one, but the present disclosure is not limited to such an aspect. For example, the determination circuit 32 may include a first determination portion that determines an ink ejection state of one of the two different ejection portions D and a second determination portion that determines an ink ejection state of the other of the two ejection portions D. The second determination portion may be operated in parallel with the first determination portion.

For example, the first determination portion may determine an ink ejection state of the odd-numbered ejection portion D, and the second determination portion may determine an ink ejection state of the even-numbered ejection portion D. Alternatively, the first determination portion may determine ink ejection states of the ejection portions D[1] to D[M], and the second determination portion may determine ink ejection states of the ejection portions D[M+1] to D[2M].

When the determination circuit 32 includes the first determination portion and the second determination portion, for example, the wiring LHs illustrated in FIG. 8 includes a wiring used to supply the detection signal Vout for the ejection portion D to be determined by the first determination portion to the first determination portion, and a wiring used to supply the detection signal Vout for the ejection portion D to be determined by the second determination portion to the second determination portion. Similarly, the wiring from the determination circuit 32 to the first storage portion 340 includes a wiring to which the determination information STT for the ejection portion D determined by the first determination portion is transmitted and a wiring to which the determination information STT for the ejection portion D determined by the second determination portion is transmitted.

The determination circuit 32 may have three or more determination portions. Also in Modification Example 1, it is possible to achieve the same effect as that of the above-described embodiment. In Modification Example 1, since the second determination portion can be operated in parallel with the first determination portion, determination for the plurality of ejection portions D can be efficiently performed.

Modification Example 2

In the embodiment and Modification Example 1 described above, a description has been made of an example of a case where the transmission/reception circuit 34 transmits the data set DS output from the first shift register 342 to the control unit 2 and the like, but the present disclosure is not limited to such an aspect. For example, as illustrated in FIG. 14, the head unit HU may include a transmission/reception circuit 35 including a first compression portion 348*a* compressing the data set DS output from the first shift register 342 instead of the transmission/reception circuit 34 illustrated in FIG. 1.

Figure 14:
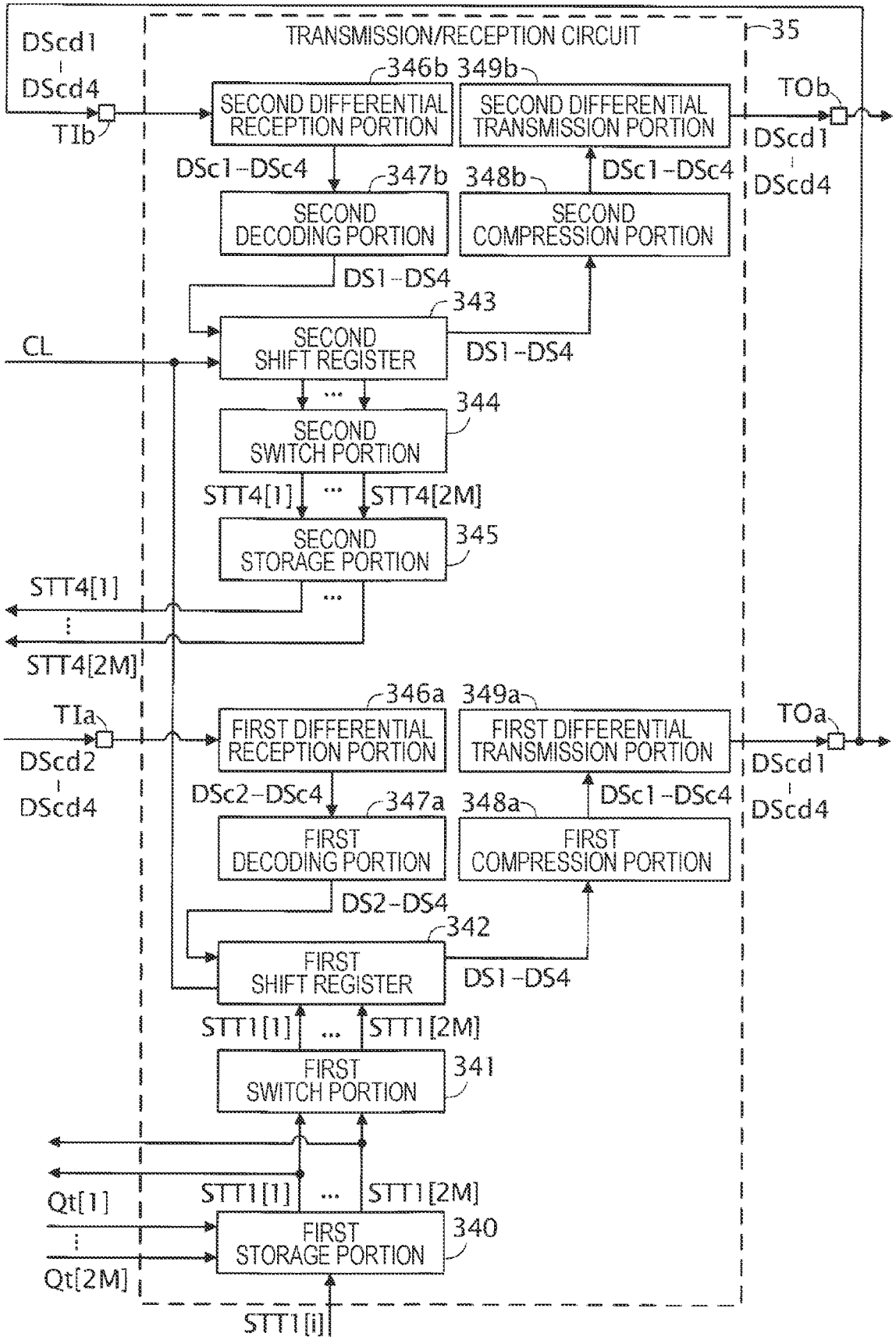
FIG. 14 is a block diagram illustrating a configuration of a transmission/reception circuit according to Modification Example 2.

FIG. 14 is a block diagram illustrating a configuration of the transmission/reception circuit 35 according to Modification Example 2. The transmission/reception circuit 35 is the same as the transmission/reception circuit 34 except that a first differential reception portion 346*a*, a first decoding portion 347*a*, a first compression portion 348*a*, a first differential transmission portion 349*a*, a second differential reception portion 346*b*, a second decoding portion 347*b*, a second compression portion 348*b*, and a second differential transmission portion 349*b* are added to the transmission/reception circuit 34 illustrated in FIG. 9.

The first compression portion 348*a* compresses the data sets DS1 to DS4 output from the first shift register 342 to generate compressed data sets DSc1 to DSc4. For example, the first compression portion 348*a* may compress the data sets DS1 to DS4 through lossless compression. Specifically, the first compression portion 348*a* may compress the data sets DS1 to DS4 through run-length compression or a compression method such as Huffman coding.

The first differential transmission portion 349*a* generates differential data signals DScd1 to DScd4 by converting the single-end compressed data sets DSc1 to DSc4 supplied from the first compression portion 348*a* into differential signals. The first differential transmission portion 349*a* supplies the differential data signals DScd1 to DScd4 to the terminal TOa of the head unit HU1. For example, the first differential transmission portion 349*a* transmits the differential data signals DScd1 to DScd4 that are low voltage differential signals to the terminal TOa of the head unit HU1. Specifically, the first differential transmission portion 349*a* transmits the differential data signals DScd1 to DScd4 based on the low voltage differential signaling (LVDS) standard. The differential data signals DScd1 to DScd4 are examples of "differential signals".

The first differential reception portion 346*a* receives the differential data signals DScd2 to DScd4 supplied to the terminal TIa of the head unit HU1. For example, the first differential reception portion 346*a* receives the differential data signals DScd2 to DScd4 based on the LVDS standard. The first differential reception portion 346*a* converts the differential data signals DScd2 to DScd4 into single-end compressed data sets DSc2 to DSc4.

The first decoding portion 347*a* restores the data sets DS2 to DS4 by decoding the single-end compressed data sets DSc2 to DSc4 supplied from the first differential reception portion 346*a*. The first decoding portion 347*a* supplies the data sets DS2 to DS4 restored from the compressed data sets DSc2 to DSc4 to the first shift register 342.

The second differential reception portion 346*b* is similar to the first differential reception portion 346*a*, the second decoding portion 347*b* is similar to the first decoding portion 347*a*, and the second compression portion 348*b* is similar to the first compression portion 348*a*. The second differential transmission portion 349*b* is similar to the first differential transmission portion 349*a*. Thus, detailed description of the second differential reception portion 346*b*, the second decoding portion 347*b*, the second compression portion 348*b*, and the second differential transmission portion 349*b* is omitted. The first differential reception portion 346*a* and the second differential reception portion 346*b* are examples of "reception portions". The first decoding portion 347*a* and the second decoding portion 347*b* are examples of "decoding portions". The first differential transmission portion 349*a* and the second differential transmission portion 349*b* are examples of "transmission portions".

The second differential reception portion 346*b* receives the differential data signals DScd1 to DScd4 supplied to the terminal TIb of the head unit HU1, and converts the differential data signals DScd1 to DScd4 into single-end compressed data sets DSc1 to DSc4.

The second decoding portion 347*b* restores the data sets DS1 to DS4 by decoding the single-end compressed data sets DSc1 to DSc4 supplied from the second differential reception portion 346*b*. The second decoding portion 347*b* supplies the data sets DS1 to DS4 restored from the compressed data sets DSc1 to DSc4 to the second shift register 343.

The second compression portion 348*b* compresses the data sets DS1 to DS4 output from the second shift register 343 to generate compressed data sets DSc1 to DSc4. The second compression portion 348*b* is another example of the "encoding portion".

The second differential transmission portion 349*b* generates the differential data signals DScd1 to DScd4 by converting the single-end compressed data sets DSc1 to DSc4 supplied from the second compression portion 348*b* into differential signals. The second differential transmission portion 349*b* supplies the differential data signals DScd1 to DScd4 to the terminal TOb of the head unit HU1. The second differential transmission portion 349*b* is another example of the "differential transmission circuit".

A configuration of the transmission/reception circuit 35 according to Modification Example 2 is not limited to the example illustrated in FIG. 14. For example, the first differential reception portion 346*a*, the first differential transmission portion 349*a*, the second differential reception portion 346*b*, and the second differential transmission portion 349*b* may be omitted. For example, the first decoding portion 347*a*, the first compression portion 348*a*, the second decoding portion 347*b*, and the second compression portion 348*b* may be omitted.

Alternatively, among the first decoding portion 347*a*, the first compression portion 348*a*, the second decoding portion 347*b*, and the second compression portion 348*b*, only the first decoding portion 347*a* may be omitted. In this case, the first compression portion 348*a* compresses the data set DS1 to generate the compressed data set DSc1. The first compression portion 348*a* does not perform a compression process on the compressed data sets DSc2 to DSc4 supplied from the first differential reception portion 346*a* via the first shift register 342. In other words, the compressed data sets DSc2 to DSc4 are supplied to the first differential transmission portion 349*a* from the first differential reception portion 346*a* via the first shift register 342.

The first compression portion 348*a* may compress only the determination information STT of the recording head information INFhd and the determination information STT included in the data set DS. In this case, the second decoding portion 347*b* may be included in the second switch portion 344, and thus the second compression portion 348*b* may be omitted. For example, when the compressed data set DSc4 is supplied to the second shift register 343, the second decoding portion 347*b* of the head unit HU1 stores the data set DS4 restored from the compressed data set DSc4 into the second storage portion 345. In this case, the compressed data sets DSc1 to DSc4 are supplied to the second differential transmission portion 349*b* from the second differential reception portion 346*b* via the second shift register 343.

Also in Modification Example 2, it is possible to achieve the same effects as those of the above-described embodiment and Modification Example 1. In Modification Example 2, since the data set DS is compressed, it is possible to reduce an amount of the data set DS transmitted between the head units HU or between the head unit HU and the control unit 2. Since the data set DS is compressed in a lossless manner, when the compressed data set DSc is decoded, the same information as the data set DS before compression can be obtained. Consequently, it is possible to accurately transmit the determination information STT indicating the ejection portion D in an abnormal ejection state.

When the compressed data set DSc is transmitted as the differential data signal DScd, it is possible to improve the resistance to noise compared with a case where the single-end compressed data set DSc is transmitted. Particularly, when the differential data signal DScd is transmitted based on the LVDS standard, the differential data signal DScd can be stably transmitted.

Modification Example 3

A description has been made of an example of a case where the determination information STT is information indicating whether or not an ink ejection state of the ejection portion D is abnormal in the embodiment, Modification Example 1, and Modification Example 2 described above, but the present disclosure is not limited to thereto. For example, as illustrated in FIG. 15, the determination information STT may be information indicating any one of a normal ejection state, an abnormal ejection state, and a failure in the ejection portion D. Alternatively, as illustrated in FIG. 16, the determination information STT may be information including cause information indicating a cause of an abnormal ejection state of the ejection portion D.

FIG. 15 is an explanatory diagram for describing an example of the determination information STT according to Modification Example 3. In the example illustrated in FIG. 15, the determination information STT indicates a state of the ejection portion D with 2 bits such as pieces of determination information STTa and STTb. For example, the determination information STTa is set to "0" when an ink ejection state of the ejection portion D is normal, and is set to "1" when an ink ejection state of the ejection portion D is not normal. In other words, the determination information STTa is information indicating whether or not an ink ejection state of the ejection portion D is abnormal. The determination information STTb is set to "1" when it is determined that the ejection portion D fails, and is set to "0" when it is determined that the ejection portion D does not fail. For example, the determination circuit 32 may have a history of the ejection portion D that has been determined as being in abnormal ejection state, and determine that the ejection portion D determined as being in the abnormal ejection state fails even when a maintenance process is performed a predetermined number of times or more by the maintenance unit 6.

When in ink ejection state of the ejection portion D is normal, a normal printing process is executed. When an ink ejection state of the ejection portion D is normal, a complementary printing process and a maintenance process are executed. When the ejection portion D fails, the complementary printing process is executed. When the ejection portion D fails, the control unit 2 may stop transmission of the printing signal SI to the head unit HU based on the determination information STT.

FIG. 16 is an explanatory diagram for describing another example of the determination information STT according to Modification Example 3. In the example illustrated in FIG. 16, the determination information STT indicates a state of the ejection portion D and a cause of an abnormal ejection state of the ejection portion D with 5 bits such as pieces of determination information STTa, STTb, STTc, STTd, and STTe. For example, the determination information STTa is set to "0" when an ink ejection state of the ejection portion D is normal, and is set to "1" when an ink ejection state of the ejection portion D is not normal. The determination information STTb is set to "1" when it is determined that the ejection portion D fails, and is set to "0" when it is determined that the ejection portion D does not fail. The determination information STTc is set to "1" when the abnormal ejection occurs due to inclusion of bubbles. The determination information STTd is set to "1" when the abnormal ejection occurs due to thickening of ink. The determination information STTe is set to "1" when the abnormal ejection occurs due to adhesion of a foreign substance.

In the example illustrated in FIG. 16, the determination information STTa may be omitted. In this case, the head unit HU or the like may obtain information corresponding to the determination information STTa from a result of a logical sum of the pieces of determination information STTb, STTc, STTd, and STTe. The determination information STT may indicate the five items such as normal, bubble, thickening, adhesion, and failure illustrated in FIG. 16 with 3-bit data. When the determination information STT includes cause information indicating any one of a plurality of causes of the abnormal ejection state of the ejection portion D, the data set DS may include information for identifying the plurality of causes. For example, the recording head information INFhd may include information for identifying a plurality of causes.

Specifically, the information for identifying the plurality of causes is, for example, information indicating that the cause of abnormal ejection indicated by (STTa, STTb, STTc, STTd, STTe)=(1, 0, 1, 0, 0) is inclusion of bubbles in the determination information STT illustrated in FIG. 16. Also in Modification Example 3, it is possible to achieve the same effects as those of the embodiment, Modification Example 1, and Modification Example 2 described above.

Modification Example 4

In the embodiment and the modification examples from the Modification Example 1 to Modification Example 3, a description has been made of an example of a case where the plurality of nozzles N belonging to the nozzle string LN are arranged in one row, but the present disclosure is not limited to such an aspect. For example, the plurality of nozzles N belonging to the nozzle string LN may be arranged in two rows as illustrated in FIG. 17.

FIG. 17 is an explanatory diagram for describing an arrangement of the nozzles N according to Modification Example 4. In FIG. 17, six patterns are illustrated as an example of the arrangement of the plurality of nozzles N belonging to the nozzle string LN.

In the example illustrated in FIG. 17, arrangement information regarding a value "01" and arrangement information regarding a value "02" indicate that the plurality of nozzles N belonging to the nozzle string LN are arranged in one row. The arrangement information regarding the value "01" indicates that nozzle numbers are sequentially assigned from the nozzle N located in the +X direction. The nozzle numbers are, for example, numbers assigned to the nozzles N in order to identify the plurality of nozzles N. The arrangement information regarding the value "02" indicates that the nozzle numbers are sequentially assigned from the nozzle N located in the −X direction.

Arrangement information regarding a value "03" and arrangement information regarding a value "04" indicate that the plurality of nozzles N belonging to the nozzle string LN are arranged in two rows. The arrangement information regarding the value "03" indicates that the nozzle numbers are sequentially assigned from the nozzles N belonging to the row located in the −Y direction of the two rows. The arrangement information regarding the value "04" indicates that the nozzle numbers are alternately assigned to the nozzles N belonging to the row located in the −Y direction and the nozzles N belonging to the row located in the +Y direction from the nozzles N located in the +X direction.

Arrangement information regarding a value "05" and arrangement information regarding a value "06" indicate that the plurality of nozzles N belonging to the nozzle string LN are arranged in zigzag. The zigzag arrangement indicates, for example, that positions in the +Y direction of the even-numbered nozzles N and the odd-numbered nozzles N from the +X direction in FIG. 17 are different from each other. The arrangement information regarding the value "05" indicates that the nozzle numbers are sequentially assigned from the nozzle N belonging to the row located in the −Y direction of the two rows. The arrangement information regarding the value "06" indicates that the nozzle numbers are alternately assigned to the nozzles N belonging to the row located in the −Y direction and the nozzles N belonging to the row located in the +Y direction from the nozzles N located in the +X direction.

Also in Modification Example 4, it is possible to achieve the same effects as those of the embodiment and the modification examples of the Modification Examples 1 to 3 described above.

Modification Example 5

In the embodiment and the modification examples from Modification Example 1 to Modification Example 4 described above, a description has been made of an example of a case where the data set DS4 for the head unit HU4 is supplied to the head unit HU1 via the head units HU3 and HU2, but the present disclosure is not limited to such an aspect. For example, as illustrated in FIG. 18, the head module 3 may have a path via which the data set DS4 for the head unit HU4 is supplied to the head unit HU1 without passing through the head units HU3 and HU2.

Figure 18:
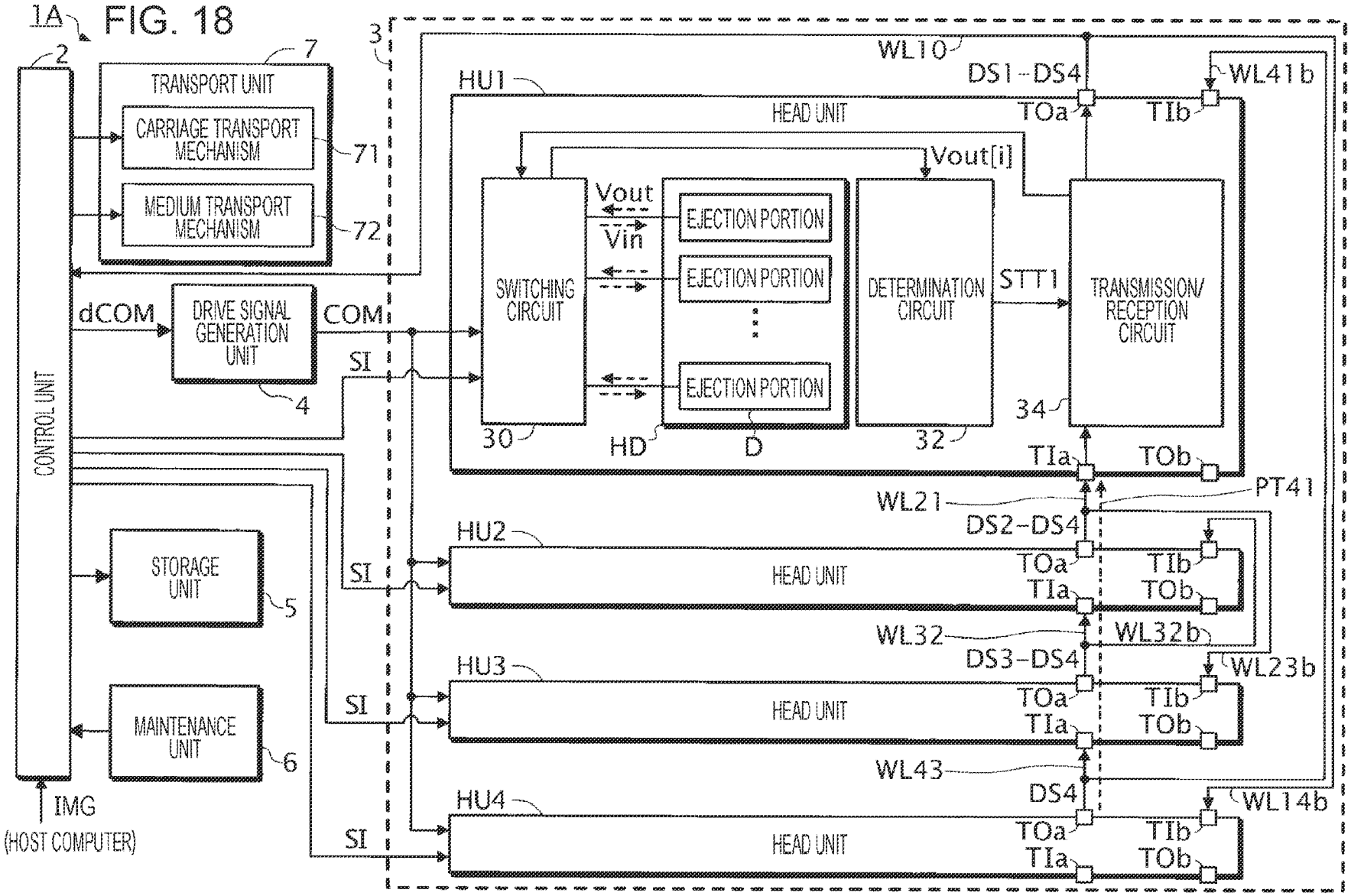
FIG. 18 is a block diagram illustrating an example of a configuration of an ink jet printer according to Modification Example 5.

FIG. 18 is a block diagram illustrating an example of a configuration of an ink jet printer 1A according to Modification Example 5. The ink jet printer 1A illustrated in FIG. 18 is the same as the ink jet printer 1 illustrated in FIG. 1 except for a coupling relationship among the four head units HU. For example, in the ink jet printer 1A, the wirings WL11, WL12, WL23, and WL34 illustrated in FIG. 1 are omitted from the ink jet printer 1, and wirings WL14*b*, WL23*b*, WL32*b*, and WL41*b* are added to the ink jet printer 1. Wirings WL10, WL21, WL32, and WL43 are the same as the wirings WL10, WL21, WL32, and WL43 illustrated in FIG. 1.

In the example illustrated in FIG. 18, the terminal TOb of each of the head units HU1 to HU4 is not coupled to other head units HU.

The wiring WL14*b* electrically couples the terminal TOa of the head unit HU1 to the terminal TIb of the head unit HU4. The wiring WL23*b* electrically couples the terminal TOa of the head unit HU2 to the terminal TIb of the head unit HU3.

The wiring WL32*b* electrically couples the terminal TOa of the head unit HU3 to the terminal TIb of the head unit HU2. The wiring WL41*b* electrically couples the terminal TOa of the head unit HU4 and the terminal TIb of the head unit HU1. Each of the wirings WL14*b*, WL23*b*, WL32*b*, and WL41*b* is another example of the "signal path". Next, a description will be made of a flow of each data set DS when the head units HU1, HU2, HU3, and HU4 are coupled as illustrated in FIG. 18.

The flow of the data sets DS1 to DS4 supplied to the control unit 2 is the same as that in the ink jet printer 1 illustrated in FIG. 1. In other words, the head unit HU1 transmits the data sets DS1 to DS4 to the control unit 2 in an order of the data sets DS1, DS2, DS3, and DS4.

The data set DS1 is supplied from the terminal TOa of the head unit HU1 to the terminal TIb of the head unit HU4 via the wiring WL14*b* without passing through the head units HU2 and HU3. The data set DS2 is supplied from the terminal TOa of the head unit HU2 to the terminal TIb of the head unit HU3 via the wiring WL23*b* without passing through the head unit HU1. The data set DS3 is supplied from the terminal TOa of the head unit HU3 to the terminal TIb of the head unit HU2 via the wiring WL32*b* without passing through the head unit HU1. The data set DS4 is supplied from the terminal TOa of the head unit HU4 to the terminal TIb of the head unit HU1 via the wiring WL41*b* without passing through the head units HU3 and HU2.

In the example illustrated in FIG. 18, for example, the second switch portion 344 and the second storage portion 345 illustrated in FIG. 9 and the like may be omitted. In this case, for example, in the head unit HU1, the supply of the clock signal CL to the second shift register 343 may be stopped after the determination information STT4[1] to STT4[2M] is held in the second shift register 343. In this case, the second shift register 343 is another example of the "storage portion". Also in Modification Example 5, it is possible to achieve the same effects as those of the embodiment and the modification examples of the Modification Examples 1 to 4 described above. In Modification Example 5, since the data set DS initially supplied to the terminal TIb of each head unit HU is the data set DS for the paired head unit HU, the data set DS for the paired head unit HU can be easily specified.

Modification Example 6

In the embodiment and the modification examples from Modification Example 1 to Modification Example 5 described above, a description has been made of an example of a case where, when determination for all of the 2M ejection portions D included in the head unit HU is finished, the determination information STT is transmitted to another head unit HU, but the present disclosure is not limited to such an aspect. For example, the transmission of the determination information STT to another head unit HU or the like may be executed when determination for two or more ejection portions D among the ejection portions D[1] to D[2M] is finished. Specifically, for example, the transmission of the determination information STT to another head unit HU or the like may be executed when determination for M ejection portions D among the ejection portions D[1] to D[2M] is finished.

Also in Modification Example 6, the plurality of pieces of determination information STT are transmitted to another head unit HU or the like as one data set DS. Therefore, also in Modification Example 6, it is possible to achieve the same effects as those of the embodiment and the modification examples from Modification Example 1 to Modification Example 5 described above.

What is claimed is:

1. A liquid ejection device comprising:

a first head unit that includes a plurality of first ejection portions, a first determination circuit that determines a liquid ejection state of each of the plurality of first ejection portions and generates first determination information indicating whether or not the liquid ejection state of each of the plurality of first ejection portions is abnormal, and a first transmission portion that transmits the first determination information;

a second head unit that includes a plurality of second ejection portions, a second determination circuit that determines a liquid ejection state of each of the plurality of second ejection portions and generates second determination information indicating whether or not the liquid ejection state of each of the plurality of second ejection portions is abnormal, and a second transmission portion that transmits the second determination information;

a head controller that controls the first head unit and the second head unit;

a first signal path via which the first determination information is transmitted from the first head unit to the second head unit without passing through the head controller; and a second signal path via which the second determination information is transmitted from the second head unit to the first head unit without passing through the head controller, the second signal path being different from the first signal path, the first transmission portion transmitting the first determination information from the first head unit to the second head unit without the first determination information passing through the head controller, after the first determination circuit determines the liquid ejection state for all of the plurality of first ejection portions, and the second transmission portion transmitting the second determination information from the second head unit to the first head unit without the second determination information passing through the head controller, after the second determination circuit determines the liquid ejection state for all of the plurality of second ejection portions.

2. The liquid ejection device according to claim 1, wherein the second head unit further includes a complementing portion that adjusts a liquid ejection amount in one second ejection portion among the plurality of second ejection portions based on the first determination information received from the first head unit via the first signal path.

3. The liquid ejection device according to claim 1, wherein the second head unit further includes a storage portion that stores the first determination information received from the first head unit via the first signal path.

4. The liquid ejection device according to claim 1, wherein the second head unit further includes a decoding portion that restores the first determination information that is compressed, when the first determination information received from the first head unit via the first signal path is compressed.

5. The liquid ejection device according to claim 1, wherein the first transmission portion transmits the first determination information as a differential signal to the second head unit via the first signal path, and the second head unit further includes a reception portion that receives the differential signal from the first head unit via the first signal path.

6. The liquid ejection device according to claim 5, wherein the first transmission portion transmits the differential signal to the second head unit via the first signal path based on an LVDS standard, and the reception portion receives the differential signal from the first head unit via the first signal path based on the LVDS standard.

7. The liquid ejection device according to claim 1, wherein the second head unit further includes a signal generation portion that generates, based on the first determination information, a complementary control signal for controlling whether or not a liquid ejection amount in one second ejection portion is increased from a liquid ejection amount based on image information indicating an image to be formed on a medium.

8. The liquid ejection device according to claim 7, wherein when the first determination information indicates that a liquid ejection state of one first ejection portion among the plurality of first ejection portions is abnormal, the complementary control signal indicates that the liquid ejection amount in the one second ejection portion is increased from the liquid ejection amount based on the image information.

* * * * *